US010965031B2

(12) United States Patent
Shin et al.

(10) Patent No.: US 10,965,031 B2
(45) Date of Patent: Mar. 30, 2021

(54) ANTENNA STRUCTURE AND ELECTRONIC DEVICE INCLUDING THE SAME

(71) Applicant: SAMSUNG ELECTRONICS CO., LTD., Suwon-si (KR)

(72) Inventors: Dongsik Shin, Suwon-si (KR); Youngsub Kim, Suwon-si (KR); Seungho Choi, Suwon-si (KR); Jungmin Park, Suwon-si (KR); Jongwook Zeong, Suwon-si (KR); Jonghwa Kim, Suwon-si (KR); Youngju Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/914,874

(22) Filed: Jun. 29, 2020

(65) Prior Publication Data

US 2020/0411992 A1 Dec. 31, 2020

(30) Foreign Application Priority Data

Jun. 28, 2019 (KR) ..... 10-2019-0077930

(51) Int. Cl.
*H01Q 21/00* (2006.01)
*H01Q 1/24* (2006.01)
(Continued)

(52) U.S. Cl.
CPC ..... *H01Q 9/045* (2013.01); *H01Q 1/24* (2013.01); *H01Q 5/35* (2015.01); *H01Q 21/00* (2013.01); *H01Q 21/24* (2013.01)

(58) Field of Classification Search
CPC ..... H01Q 9/045; H01Q 5/35; H01Q 21/24; H01Q 21/00; H01Q 1/24
(Continued)

(56) References Cited

U.S. PATENT DOCUMENTS 5,241,321 A * 8/1993 Tsao ..... H01Q 9/0435 343/700 MS
6,133,880 A * 10/2000 Grangeat ..... H01P 5/08 343/700 MS
(Continued)

FOREIGN PATENT DOCUMENTS

CN 107978852 A 5/2018

OTHER PUBLICATIONS

Kapinas et al., "Aspects on space and polarization diversity in wireless communication systems", 15th Telecommunications Forum, Nov. 20-22, 2007, pp. 183-186.
(Continued)

*Primary Examiner* — Hai V Tran
(74) *Attorney, Agent, or Firm* — Nixon & Vanderhye P.C.

(57) ABSTRACT

The present disclosure relates to a pre-5th-Generation (5G) or 5G communication system to be provided for supporting higher data rates Beyond 4th-Generation (4G) communication system such as Long Term Evolution (LTE). According to embodiments in the present disclosure, an antenna device for dual polarization of a wireless communication system, comprises a print circuit board (PCB); a first feeding line configured to provide a first polarization signal; a second feeding configured to provide a second polarization signal; and a patch antenna comprising a radiating region and cutting regions. Objects corresponding to the cutting regions are disposed to support the radiating region on the PCB.

20 Claims, 13 Drawing Sheets

(51) Int. Cl.
*H01Q 9/04* (2006.01)
*H01Q 21/24* (2006.01)
*H01Q 5/35* (2015.01)

(58) Field of Classification Search
USPC ..... 343/702
See application file for complete search history.

(56) References Cited

U.S. PATENT DOCUMENTS

| | | | | |
|---|---|---|---|---|
| 8,890,750 | B2 | 11/2014 | Mak et al. | |
| 9,030,364 | B2 | 5/2015 | Zhuang | |
| 9,577,337 | B2 | 2/2017 | Jung et al. | |
| 2003/0117325 | A1 | 6/2003 | Jo et al. | |
| 2003/0150099 | A1 | 8/2003 | Lebanic et al. | |
| 2004/0196200 | A1* | 10/2004 | Sievenpiper | H01Q 9/0421 343/770 |
| 2004/0227670 | A1* | 11/2004 | Higasa | H01Q 21/24 343/700 MS |
| 2009/0174613 | A1* | 7/2009 | Liu | H01Q 25/005 343/702 |
| 2014/0361952 | A1* | 12/2014 | Dobric | H01Q 1/3275 343/893 |
| 2015/0194730 | A1* | 7/2015 | Sudo | H01Q 5/378 343/905 |
| 2018/0062256 | A1* | 3/2018 | Kim | H01Q 13/02 |
| 2019/0326675 | A1* | 10/2019 | Kim | H01Q 9/0485 |
| 2019/0393619 | A1* | 12/2019 | Kim | H01Q 19/005 |
| 2020/0144708 | A1* | 5/2020 | Kim | H05K 1/0243 |
| 2020/0295463 | A1* | 9/2020 | Yamada | H01Q 9/0414 |

OTHER PUBLICATIONS

Jooter et al., "Performance of polarization diversity in correlated Nakagami-m fading channels", IEEE Transactions on Vehicular Technology, vol. 55, No. 1, Jan. 2006, pp. 128-136.

Yuan et al.,"A cross-polarization discrimination compensation algorithm for polarization modulation", IEEE 27$^{th}$ Annual International Symposium on Personal, Indoor and Mobile Radio Communications, 2016, 6 pages.

PCT Written Opinion dated Oct. 20, 2020 for PCT/KR2020/008474 (6pgs).

PCT International Search Report dated Oct. 20, 2020 for PCT/KR2020/008474 (3pgs).

* cited by examiner

ANTENNA STRUCTURE AND ELECTRONIC DEVICE INCLUDING THE SAME

CROSS-REFERENCE TO RELATED APPLICATION

This application is based on and claims priority under 35 U.S.C. § 119 to Korean Patent Application No. 10-2019-0077930, filed on Jun. 28, 2019, in the Korean Intellectual Property Office, the disclosure of which is incorporated by reference herein in its entirety.

BACKGROUND

1) Field

The disclosure relates to an antenna structure and an electronic device including the same.

2) Description of Related Art

To meet the demand for wireless data traffic having increased since deployment of 4G communication systems, efforts have been made to develop an improved 5G or pre-5G communication system. Therefore, the 5G or pre-5G communication system may also be called a 'Beyond 4G Network' or a 'Post LTE System'.

The 5G communication system is considered to be implemented in higher frequency (mmWave) bands, e.g., 60 GHz bands, so as to accomplish higher data rates. To decrease propagation loss of the radio waves and increase the transmission distance, the beamforming, massive multiple-input multiple-output (MIMO), Full Dimensional MIMO (FD-MIMO), array antenna, an analog beam forming, large scale antenna techniques are discussed in 5G communication systems.

In addition, in 5G communication systems, development for system network improvement is under way based on advanced small cells, cloud Radio Access Networks (RANs), ultra-dense networks, device-to-device (D2D) communication, wireless backhaul, moving network, cooperative communication, Coordinated Multi-Points (CoMP), reception-end interference cancellation and the like.

In the 5G system, Hybrid FSK and QAM Modulation (FQAM) and sliding window superposition coding (SWSC) as an advanced coding modulation (ACM), and filter bank multi carrier (FBMC), non-orthogonal multiple access (NOMA), and sparse code multiple access (SCMA) as an advanced access technology have been developed.

A dual polarization antenna including two antenna ports is used for polarization diversity. In order to increase communication performance, improvement of the performance of a cross polarization ratio (CPR) has been required in a dual polarization antenna.

The above information is presented as background information only to assist with an understanding of the disclosure. No determination has been made, and no assertion is made, as to whether any of the above might be applicable as prior art with regard to the disclosure.

SUMMARY

Embodiments of the disclosure provide a structure for connecting a radiating patch and a coupling patch of an antenna, and an electronic device including the same.

Embodiments of the disclosure also provide a contact structure of metals that allows an surface mounted technology (SMT) through a bending structure of at least one surface of a metallic radiating patch, and an electronic device including the same.

Embodiments of the disclosure also provide an antenna structure that has an improved CPR performance by satisfying symmetry between two antenna ports through a bending structure of at least one surface of a metallic radiating patch, and an electronic device including the same.

In accordance with an example embodiment of the disclosure, an antenna device for dual polarization of a wireless communication system, comprises a print circuit board (PCB); a first feeding line for providing a first polarization signal; a second feeding for providing a second polarization signal; and a patch antenna comprising a radiating region and cutting regions. Objects corresponding to the cutting regions are disposed to support the radiating region on the PCB.

In accordance with an example embodiment of the disclosure, an electronic device for dual polarization of a wireless communication system, comprises at least one processor; at least one transceiver; and a plurality of antenna modules on a print circuit board (PCB). One antenna module of the plurality of antenna modules comprises: a first feeding line for providing a first polarization signal; a second feeding for providing a second polarization signal; and a patch antenna comprising a radiating region and cutting regions. Objects corresponding to the cutting regions are disposed to support the radiating region on the PCB.

In accordance with an example embodiment of the disclosure, an antenna device prepared by a process comprising steps of: (a) providing a metal plate of a patch antenna comprising a radiating region and cutting regions; (b) forming support objects by bending the cutting regions of the metal plate; and (c) contacting the support objects to a print circuit board (PCB) in which a first feeding line for a first polarization and a second feeding for a second polarization.

In accordance with an example embodiment of the disclosure, an antenna module for dual polarization of a wireless communication system may include: an antenna substrate, a first antenna component comprising a first polarization antenna disposed on the antenna substrate, a second antenna component comprising a second polarization antenna disposed on the antenna substrate, a coupling patch disposed on the antenna substrate and electrically connected to the first antenna component and the second antenna component, and a radiating patch configured to radiate a signal receive from the coupling patch, wherein the antenna module includes a support including at least one region of one surface of the radiating patch bent to connect the radiating patch and the coupling patch.

In accordance with another example embodiment of the disclosure, an electronic device for dual polarization of a wireless communication system may include: at least one processor, at least one transceiver, and a plurality of antenna modules, wherein each of the antenna modules includes an antenna substrate, a first antenna component comprising a first polarization antenna, a second antenna component comprising a second polarization antenna, a coupling patch, and a radiating patch, wherein each of the antenna modules includes a support including at least one region of one surface of the radiating patch bent to connect the radiating patch and the coupling patch corresponding to the radiating patch.

According to various example embodiments of the disclosure, a CPR performance can be secured and production costs can be reduced through a structure that connects the radiating patch and the coupling patch through a bending structure of the radiating patch.

Effects obtainable from the disclosure may not be limited to the above mentioned effects, and other effects which are not mentioned may be clearly understood, through the following descriptions, by those skilled in the art to which the disclosure pertains.

BRIEF DESCRIPTION OF THE DRAWINGS

The above and other aspects, features, and advantages of certain embodiments of the present disclosure will be more apparent from the following detailed description, taken in conjunction with the accompanying drawings, in which.

DETAILED DESCRIPTION

The terms used in the disclosure are used to describe various example embodiments, and are not intended to limit the disclosure. A singular expression may include a plural expression unless they are definitely different in a context. Unless defined otherwise, all terms used herein, including technical and scientific terms, have the same meaning as those commonly understood by a person skilled in the art to which the disclosure pertains. Such terms as those defined in a generally used dictionary may be interpreted to have the meanings equal to the contextual meanings in the relevant field of art, and are not to be interpreted to have ideal or excessively formal meanings unless clearly defined in the disclosure. In some cases, even the term defined in the disclosure should not be interpreted to exclude embodiments of the disclosure.

Hereinafter, various example embodiments of the disclosure will be described based on an approach of hardware. However, various embodiments of the disclosure include a technology that uses both hardware and software, and thus the various embodiments of the disclosure may not exclude the perspective of software.

The disclosure relates to an antenna structure for a wireless communication system and an electronic device including the same. For example, the disclosure discloses a technology for improving the CPR performance of a dual-polarized antenna by, for example, cutting and/or bending (or folding) at least one surface of a radiating patch and providing an efficient antenna structure in aspects of performance, space, and costs. For example, because it is expected that equipment having a much larger number of antennas will be used more widely through a massive MIMO technology, design of a more efficient antenna is required in aspects of a manufacturing time and production costs together with a higher CPR performance.

Hereinafter, the terms (e.g., a substrate, a printed circuit board (PCB), a flexible PCB (FPCB), a module, an antenna, an antenna element, a circuit, a processor, a chip, a component, and a device) for indicating parts of an electronic device, the terms (e.g., a structure body, a structure, a support part, a contact part, a protrusion, and an opening) for indicating the shapes of parts, the terms (e.g., a connection part, a contact part, a support part, a contact structure, a conductive member, and an assembly) for indicating connection parts between structures, and the terms (e.g., a PCB, an FPCB, a signal line, a feeding line, a data line, an RF signal line, an antenna line, an RF path, an RF module, and an RF circuit) for indicating a circuit may be used by way of example for convenience of description. Accordingly, the disclosure is not limited to the foregoing terms, and other terms having equivalent technical meanings may be used. Further, the terms such as 'unit', '-er or -or', 'structure', and 'body' used herein may refer to at least one shape structure or a unit for processing a function.

Figure 1:
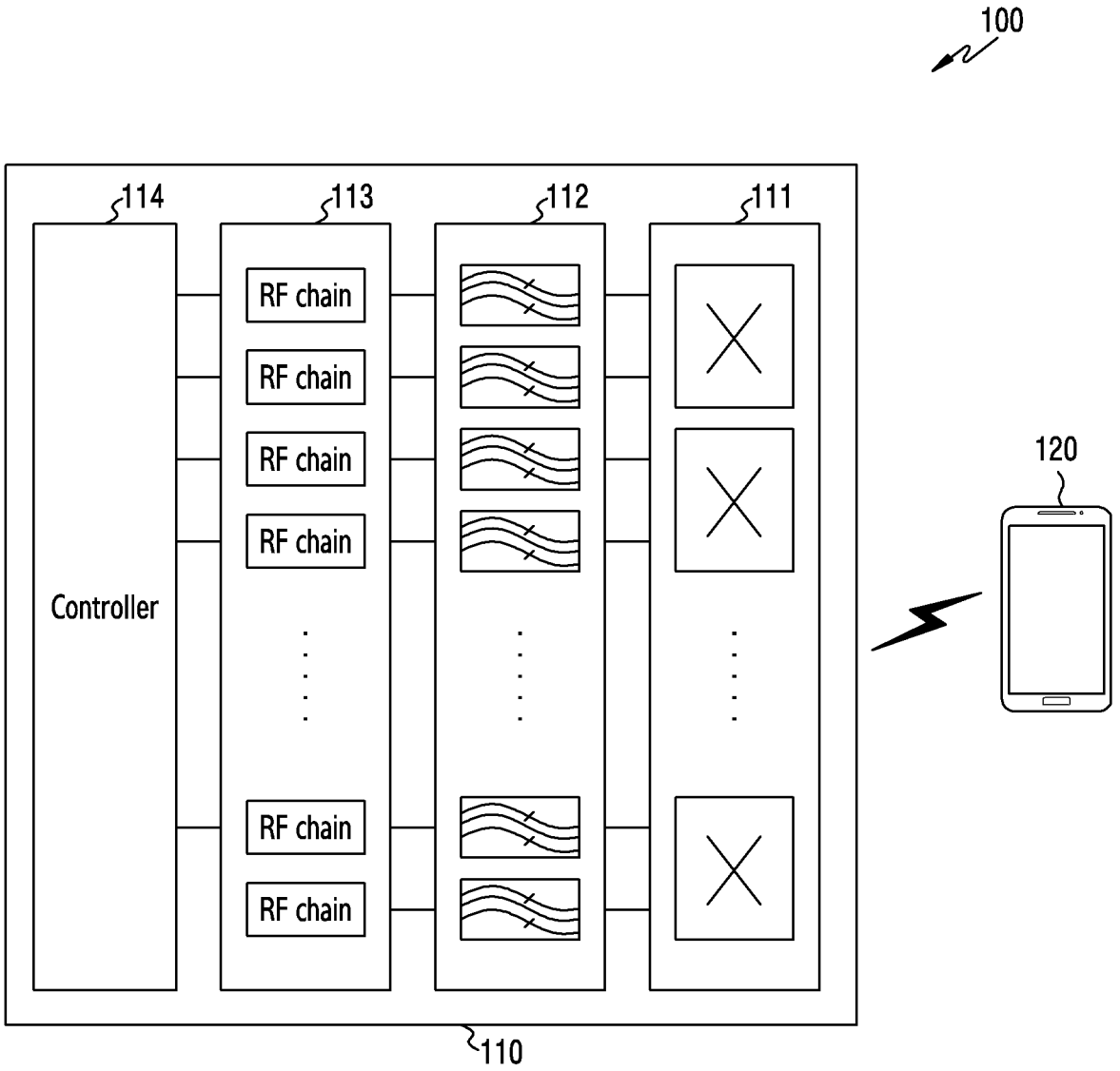
FIG. 1 is a diagram illustrating an example electronic device according to various embodiments of the disclosure.

FIG. 1 is a diagram illustrating an example electronic device according to various embodiments of the disclosure. A wireless communication environment 100 of FIG. 1 corresponds, for example, to some of nodes that use a wireless channel, and may include, by way of example, a communication node 110 and a terminal 120. As an example, the communication node 110 may be electrically connected to a base station or may be realized on a base station.

The base station is a network infrastructure that provides wireless connection. The base station has a coverage that may be defined as a specific geographical region based on a distance at which a signal may be transmitted and received. The base station may be referred to, for example, as 'an access point (AP)', 'an eNodeB (eNB)', 'a 5th generation (5G) node', 'a 5G nodeB (5G NodeB (NB))', 'a wireless point', 'a transmission/reception point (TRP)', 'an access unit', 'a distributed unit (DU)', 'a transmission/reception point (TRP)', 'a radio unit (RU)', 'a remote radio head (RRH)', or other terms having the equivalent technical meanings, in addition to a base station. The base station may transmit a downlink signal or receive an uplink signal.

The terminal 120 may refer, for example, to a device used by a user that performs communication with the base station through a wireless channel. The terminal 120 may be operated without any operation of a user. For example, the terminal 120 may refer, for example, to a device that performs machine type communication (MTC), and may not be carried by a user. The terminal 120 may, for example, be referred to 'a user equipment (UE)', 'a mobile station', 'a subscriber station', 'a customer premises equipment (CPE)', 'a remote terminal', ' a wireless terminal', 'an electronic device', 'vehicular terminal', 'a user device', or other terms having the equivalent technical meanings, in addition to a terminal.

The number of antennas (or antenna elements) of equipment that performs wireless communication has been increased to increase communication performance. Further, the number of RF parts or components for processing an RF signal received or transmitted through an antenna element also increases, and thus a spatial gain and a cost efficiency are essentially required while a communication performance is satisfied in communication equipment. In order to satisfy the requirements, a dual-polarized antenna has been used to satisfy the requirements. As a channel independency between signals of different polarizations is satisfied, a polarization diversity and a signal gain due to the polarization diversity can be increased. Accordingly, the improvement of a cross polarization ratio (CPR) in a dual-polarized antenna is advantageous.

Although components of wireless equipment (e.g., a massive MIMO unit (MMU)) connected to a base station are illustrated by way of example to explain a connection structure and an electronic device including the same according to the disclosure, various embodiments of the disclosure are not limited thereto. For example, the connection structure and the electronic device including the same according to the disclosure may be applied to the terminal 120 of FIG. 1 or another equipment that requires a stable connection structure of communication parts for signal processing.

Referring to FIG. 1, an example functional configuration of the communication node 110 is illustrated. The communication node 110 may include an antenna part 111, a filter part 112, a radio frequency (RF) processor 113, and a controller (e.g., including processing circuitry) 114.

The antenna part 111 may include a plurality of antennas. The antenna performs functions for transmitting and receiving a signal through a wireless channel. The antenna may include, for example, a radiator including a conductor or a conductive pattern formed on a substrate (e.g., a PCB). The antenna may radiate an up-converted signal onto a wireless channel or acquire a signal radiated by another device. Each antenna may be referred to an antenna element or an antenna device. In some embodiments, the antenna part 111 may include an antenna array in which a plurality of antenna elements constitute arrays. The antenna part 111 may be electrically connected to the filter part 112 through RF signal lines. The antenna part 111 may be mounted on a PCB including a plurality of antenna elements. The PCB may include a plurality of RF signal lines that connect the antenna elements and a filter of the filter part 112. The RF signal lines may be referred to as a feeding network. The antenna part 111 may provide the received signal to the filter part 112 or may radiate the signal provided from the filter part 112 to air.

The antenna part 111 according to various embodiments may include at least one antenna module having a dual-polarized antenna. The dual-polarized antenna, for example, may be a cross-polarization (x-pol) antenna. The dual-polarized antenna may include, for example, two antenna ports corresponding to different polarizations. For example, the dual-polarized antenna may include a first antenna port having a polarization of +45° and a second antenna port having a polarization of −45°. The antenna ports are connected to a feeding line, and may be electrically connected to the filter part 112, the RF processor 113, and the controller 114.

According to various embodiments, the dual-polarized antenna may include, for example, a patch antenna (or a microstrip antenna). Because the dual-polarized antenna has the form of a patch antenna, an array antenna can be easily realized and integrated. Two signals having different polarizations may be input to antenna ports. The antenna ports correspond to an antenna element. For a high efficiency, a relationship between co-pol characteristics and cross-pol characteristics between two signals having different polarizations may be improved. In the dual-polarized antenna, the co-pol characteristics may represent characteristics of a specific polarization component, and the cross-pol characteristics represent characteristics of a polarization component that is different form the specific polarization component.

The filter part 112 may perform filtering to deliver a signal of a desired frequency. The filter part 112 may perform a function for selectively identifying a frequency by forming a resonance. In some embodiments, the filter part 112 may form a resonance through a cavity structurally including a dielectric body. Further, in some embodiments, the filter part 112 may form a resonance through elements that form an inductance or a capacitance. The filter part 112 may include, for example, and without limitation, at least one of a band pass filter, a low pass filter, a high pass filter, a band reject filter, or the like. For example, the filter part 112 may include RF circuits for obtaining a signal of a frequency band for transmitting a signal or a frequency band for receiving a signal. According to various embodiments, the filter part 112 may electrically connect the antenna part 111 and the RF processor 113.

The RF processor 113 may include a plurality of RF paths. The RF path may refer, for example, to a unit of a path, along which a signal received through the antenna or a signal radiated through the antenna passes. At least one RF path may be referred to as an RF chain. The RF chain may include a plurality of RF elements. The RF elements may include, for example, and without limitation, an amplifier, a mixer, an oscillator, a digital-to-analog converter (DAC), an analog-to-digital converter (ADC), or the like. For example, the RF processor 113 may include an up converter that up-converts a digital transmission signal of a base band to a transmission frequency, and a digital-to-analog converter (DAC) that converts the up-converted digital transmission signal to an analog RF transmission signal. The up converter and the DAC may be a part of a transmission path. The transmission path may further include, for example, a power amplifier (PA) or a coupler (or a combiner). Further, for example, the RF processor 113 may include an analog-to-digital (ADC) that converts an analog RF reception signal to a digital reception signal, and a down converter that converts a digital reception signal to a digital reception signal of a base band. The ADC and the down converter may be a part of a reception path. The reception path may further include a low-noise amplifier (LNA) or a coupler (or a divider). RF parts of the RF processor may be realized on a PCB. The base station 110 may include a structure in which the antenna part 111, the filter part 112, and the RF processor 113 are sequentially stacked. The antennas and the RF parts of the RF processor may be realized on a PCB, and filters may be repeatedly coupled between the PCBs to form a plurality of layers.

The controller 114 may include various processing circuitry and control overall operations of the communication node 110. The controller 114 may include various modules for performing communication. The controller 114 may include at least one processor. The controller 114 may include modules for digital signal processing. For example, when data are transmitted, the controller 114 may generate complex symbols by encoding and modulating a transmission bit array. Further, for example, when data are transmitted, the controller 114 may restore a reception bit array through demodulation and decoding of a base band signal. The controller 114 may perform functions of a protocol stack required by communication standards.

FIG. 1 illustrates equipment for utilizing the antenna structure of the disclosure, and a functional configuration of the communication node 110 is illustrated. However, the example illustrated in FIG. 1 is simply an example configuration for utilizing an antenna structure according to various embodiments of the disclosure, and the embodiments of the disclosure are not limited to the elements of the equipment of FIG. 1. Accordingly, an antenna module, communication equipment of another configuration, and an antenna structure body including the antenna structure, which will be described in greater detail below, also may be understood as an example embodiment of the disclosure.

Figure 2A:
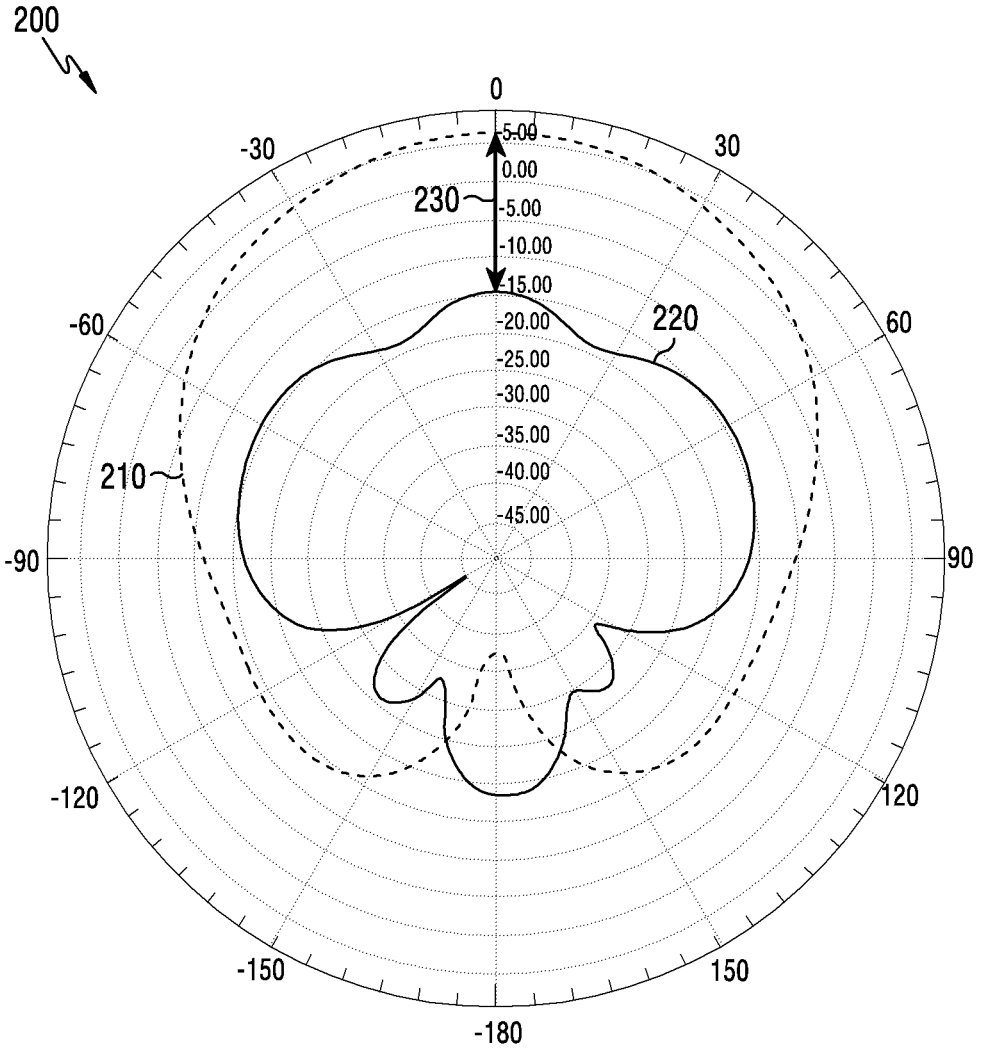
FIG. 2A is a diagram illustrating an example antenna radiation pattern for explaining a cross polarization ratio (CPR) according to various embodiments of the disclosure.

FIG. 2A is a diagram illustrating an example 200 of an antenna radiation pattern for explaining a cross polarization ratio (CPR) according to various embodiments of the disclosure. The radiation pattern may represent a relationship between the intensity of an electric field or a magnetic field and a physical space. The disclosure relates to an example electric field, for example, an E-plane.

If the polarization characteristics are different, the states of fading may be different. The different polarization characteristics represent that a channel correlation between signals having different polarizations is low. As signals having different polarizations undergo independent channels, polarization diversity may increase. For the polarization diversity, the dual-polarized antenna is utilized. A signal gain may increase as the polarization diversity increases, which directly causes an increase in channel capacity, and thus the independency between polarization components in the dual-polarized antenna is utilized as an index that represents the performance of the dual-polarized antenna.

Referring to FIG. 2A, the antenna radiation pattern 200 represents an example relationship between the spatial coordinates (polar coordinates) of the polarization components and the intensity of an electric field in an E-plane of the dual-polarized antenna. In order to provide two different polarization characteristics, the dual-polarized antenna includes two antenna components (i.e., antenna ports or antenna feeding lines for the antenna ports), and the antenna ports may be independently connected to the feeding line. The dual-polarized antenna may include a first antenna component for a first polarization and a second antenna component for a second polarization.

The antenna radiation pattern 200 may include two signal components. The two components may include a first component 210 and a second component 220. The first component 210 may, for example, be a co-pol component for the first polarization, and the second component 220 may, for example, be a cross-pol component for the first polarization. For example, the co-pol component may be a first polarization component of a signal transmitted through the first antenna port, and the cross-pol component may be a second polarization component of a signal transmitted through the first antenna port. The co-pol component may be measured through the antenna element in respect to the first polarization when a signal is applied to the first antenna port. The cross-pol component may be measured as the second polarization through the antenna element in respect to the second polarization when a signal is applied to the first antenna port.

The CPR may represent a ratio of two polarization components when a signal is transmitted in a specific polarization. For example, the CPR represents a ratio of the first component 210 to the second component 220. The size unit of the signals is dBi, and the CPR may be a difference 230 (e.g., about 10 dB) between the first component 210 and the second component 220 in the E-plane=0°. Because the difference between the two components increases as the size of the second component 220 decreases, the CPR may increase. Because the two polarization components of the dual-polarized antenna may be perfectly perpendicular to each other in an ideal communication system, signal components of different polarizations, that is, the cross-pol components may be perfectly interrupted. However, because two polarization components cannot be perfectly perpendicular to each other in an actual communication system, it is essential to improve CPR.

Figure 2B:
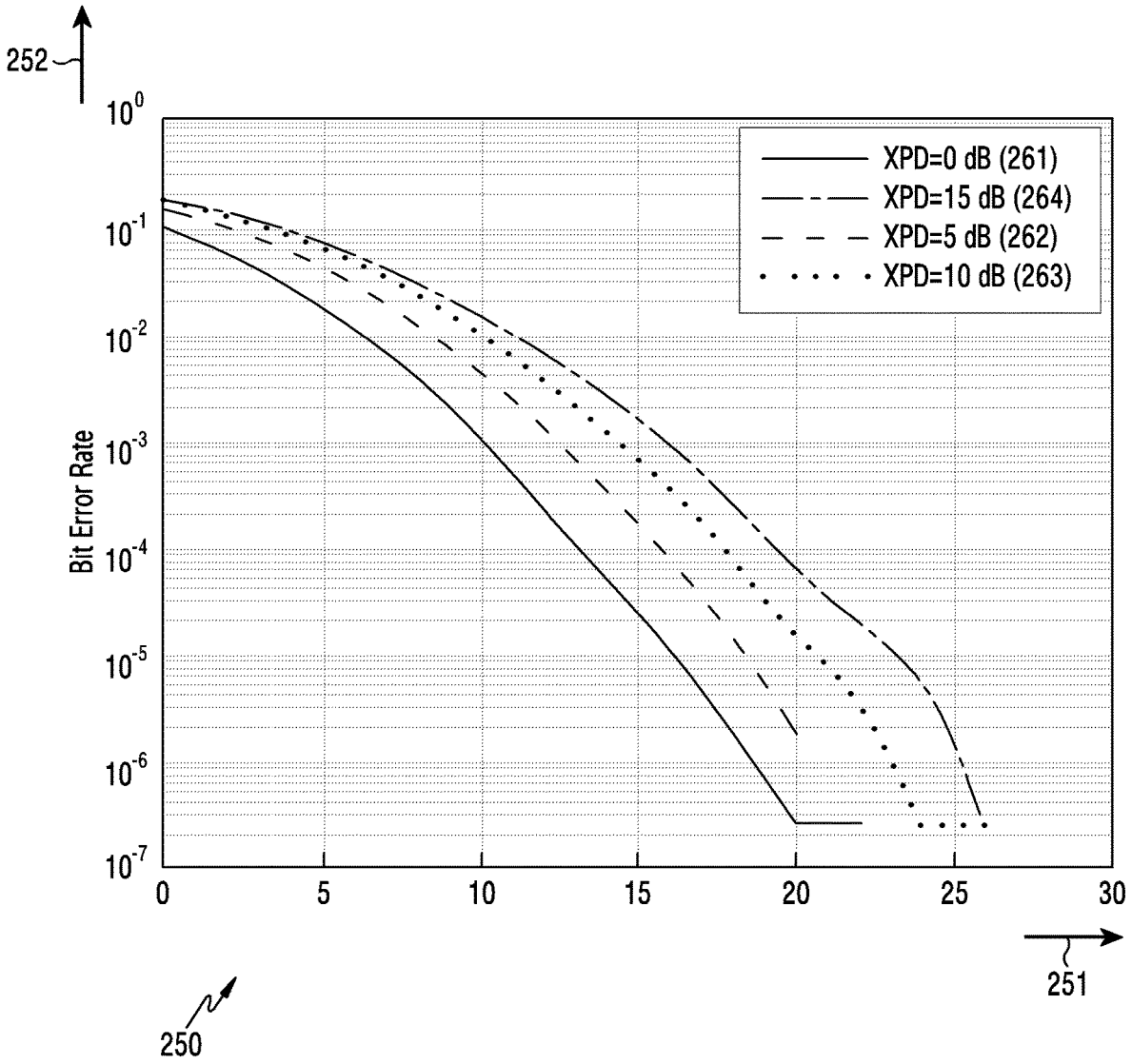
FIG. 2B is a diagram illustrating an example of a graph depicting a relationship between signal-to-noise ratios (SNRs) and bit-error rates (BER) for cross polarization discriminations (XPDs) according to various embodiments of the disclosure.

FIG. 2B is an example 250 of a graph depicting a relationship between signal-to-noise ratios (SNRs) and bit-error rates (BER) for cross polarization discriminations (XPDs) according to various embodiments of the disclosure. The cross polarization separation degree may refer, for example, to a ratio of polarization components of two polarizations when a signal of a specific polarization is radiated. For example, it may represent the above-described CPR of FIG. 2A. For example, the XPD may be expressed as in Equation 1.

$$XPD = 20\log\frac{|y_{co}|}{|y_{cross}|} \quad \text{[Equation 1]}$$

Here, $y_{co}$ represents a component of a signal received in a specific polarization, in which a signal is radiated, and $y_{cross}$ represents a component of a signal received in another polarization.

Referring to FIG. 2B, the graph 250 illustrates a relationship between an SNR and a BER. The transverse axis 251 of the graph 250 represents an SNR, and the unit is decibel (dB). The longitudinal axis 252 of the graph 250 represents a BER %, and the unit is bit/second.

The graph 250 may include four lines. The four lines include a first line 261, a second line 262, a third line 263, and a fourth line 264. The first line 261 may represent a relationship between a BER and an SNR for the dual-polarized antenna having a cross polarization separation degree of 0 dB. The second line 262 may represent a relationship between a BER and an SNR for the dual-polarized antenna having a cross polarization separation degree of 5 dB. The third line 263 may represent a relationship between a BER and an SNR for the dual-polarized antenna having a cross polarization separation degree of 10 dB. The fourth line 264 may represent a relationship between a BER and an SNR for the dual-polarized antenna having a cross polarization separation degree of 15 dB.

Referring to the graph 250, it can be identified that the SNR increases as the cross polarization separation degree increases (the first line 261→the second line 262→the third line 263→the fourth line 264) with reference to the same BER (e.g., $10^{-5}$ bit/s) As mentioned in FIG. 2A, as the independency between the two polarizations is satisfied, the polarization diversity increases. The cross polarization separation ratio may refer, for example, to a ratio of polarization amplitudes of two polarizations when a signal of the same polarization is radiated. As the cross polarization separation degree increases, the independency between two polarizations increases. Accordingly, as in the graph 250, the increase in the cross polarization separation degree improves a signal gain in the same requirements.

In FIGS. 2A and 2B, a CPR and an XPD are illustrated as an example as parameters for independently representing the independency between different polarizations. Hereinafter, the performance, the effect, the relationship between the performance and effect and the structure, and the correlation between the performance and effect and the deployment form of the structure of the antenna structure according to various embodiments are illustrated as examples, but it is apparent that another metric that represents the independency between polarizations may be used. This is because the independency between the polarizations improves the quality of a channel by improving the polarization diversity gain.

Hereinafter, various example embodiments of a connection structure of an antenna module for improving the independency between polarizations, for example, the CPR are illustrated by way of non-limiting example in FIGS. 3A, 3B, 3C, 4, 5, 6, 7, 8, 9 and 10.

Figure 3A:
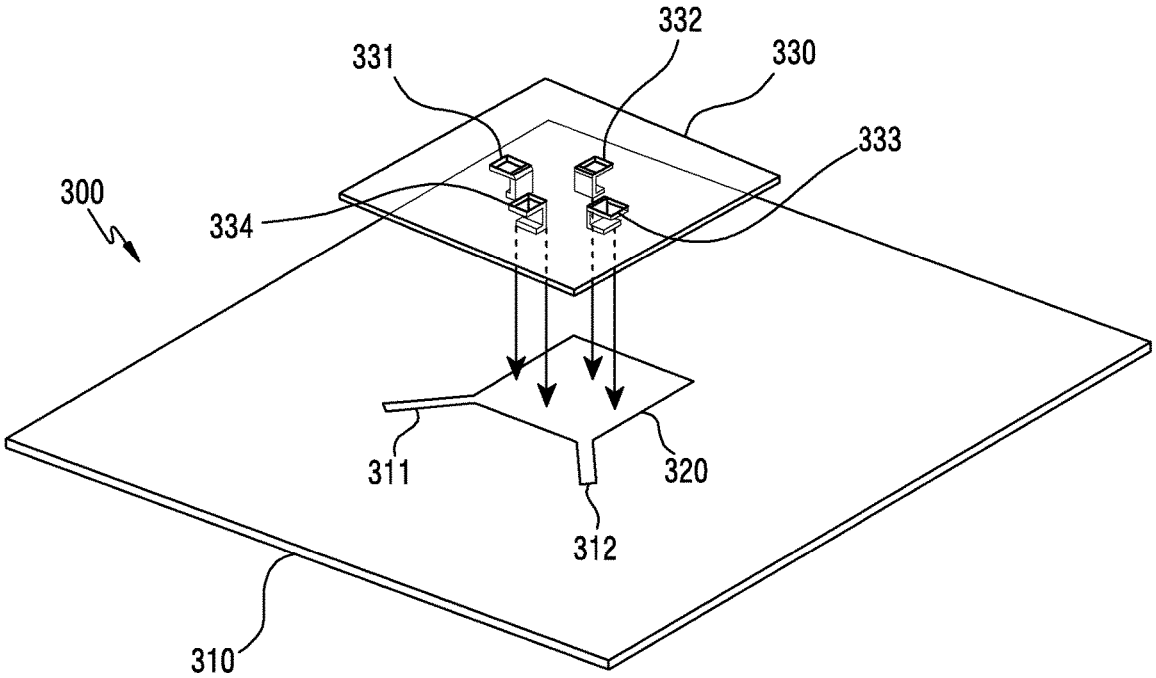
FIG. 3A is a diagram illustrating an example of an antenna module including a bending structure of a radiating patch according to various embodiments of the disclosure.
Figure 3A:
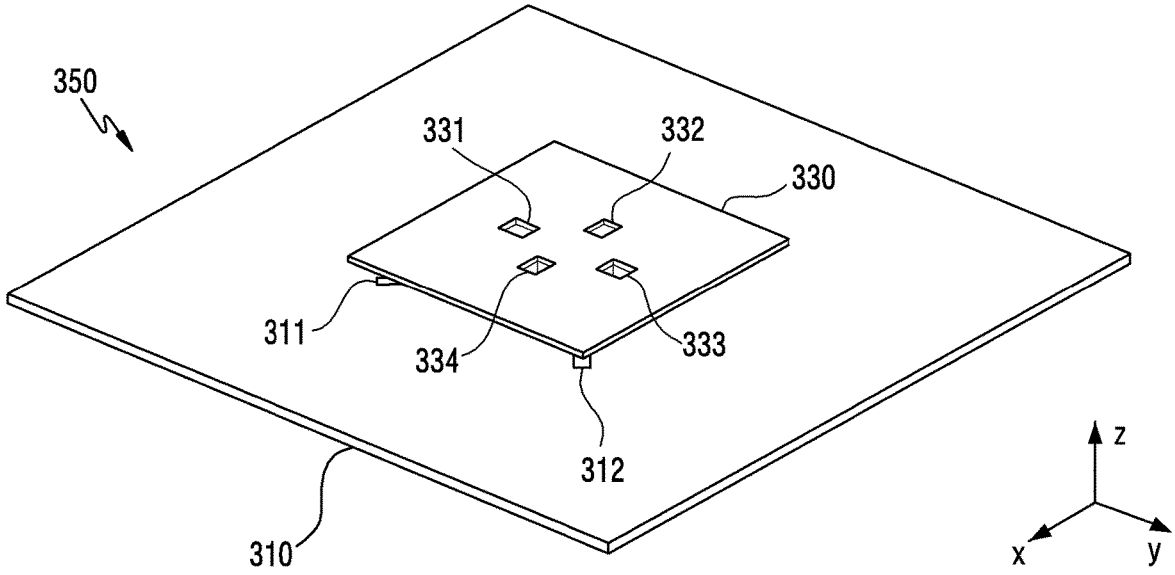

FIG. 3A is a diagram illustrating an example of an antenna module including a bending structure of a radiating patch 330 according to various embodiments of the disclosure.

Referring to FIG. 3A, the exploded view 300 illustrates individual components of the antenna module, and the assembly view 350 illustrates the assembled antenna module. The antenna module may include an antenna PCB 310, a first antenna port 311, a second antenna port 312, a coupling patch 320, a radiating patch 330, and a feeding line (or feeding lines) (not illustrated) connected to the antenna ports.

The antenna module may include a structure in which an antenna PCB 310, a coupling patch 320, and a radiating patch 330 are stacked in the z-axis direction. The coupling patch 320 may be disposed on the antenna PCB 310 of the antenna module, and the radiating patch 330 may be disposed in the (+) z-axis direction of the coupling patch 320. The radiating patch 330 may be spaced apart from the first antenna 311, the second antenna port 312, and the fed coupling patch 320 and may be located substantially in parallel to the antenna PCB 310.

The antenna PCB 310 may be an antenna substrate, and a plurality of feeding lines that supply RF signals may be attached to the antenna PCB 310. For example, the plurality of feeding lines may be printed on the antenna PCB 310. The antenna PCB 310 may include a dielectric body. The plurality of feeding lines may include a feeding line for connecting the antenna component for the first polarization in the dual-polarized antenna, and a feeding line for connecting the antenna component for the second polarization. The input port that connects the antenna components may be referred to as an antenna port.

The coupling patch 320 may be connected to the feeding line of the first antenna port 311 and the feeding line of the second antenna port 312. The coupling patch 320 may deliver signals of two antenna ports, which are input through the feeding lines, to the radiating patch 330. The first antenna port 311 may, for example, be an antenna port for the first polarization, and the second antenna port 312 may, for example, be an antenna port for the second polarization. The coupling patch 320 may include, for example, a metal board.

According to various embodiments, the radiating patch 330 may be disposed to be spaced apart from the coupling patch 320 by a specific interval. For example, the radiating patch 330 may be disposed in parallel to the coupling patch to form a resonance. The radiating patch 330 may radiate a signal of the first antenna port 311 and a signal of the second antenna port 312 provided from the coupling patch to air. The radiating patch 330 may include, for example, a metal board. The bandwidth of the radiated signal is based on a specific interval between the two patches. The specific interval between the two patches may be realized through at least a portion of the radiating patch 330.

According to various embodiments, the radiating patch 330 may have at least one bending structure (e.g., bent portion). In the disclosure, the bending structure may refer, for example, to a structure in which a surface disposed at a location that is different from one surface (e.g., a radiation surface (an xy surface)) of the plate is formed by folding a specific part of the plate (e.g., a metal board) of the radiating patch 330. The bending structure may, for example, and without limitation, be formed by cutting and/or bending at least a portion of the plate of the radiating patch 330. for example, the cut portion of the plate may not be disposed on the radiation surface of the plate any more by cutting a side of the plate, except for a specific side of at least a portion of the plate, (for example, spatially separating the side from a side of the metal board) and connecting and folding the specific side of the at least a portion. The cut portion may be referred to, for example, as a cutting part or a cutting region. For example, as four specific portions on a surface of the radiating patch 330, which is perpendicular to the z axis are cut and folded, a first bending structure 331, a second bending structure 332, a third bending structure 333, and a fourth bending structure of the radiating patch 330 may be formed. The cut portion may be a portion of the plate, which is not located on the radiation surface, and may be referred to as a bending surface. A specific side connected to the plate is a bent portion and may be referred to as a bending line. A detailed description of a bending surface and a bending line will be made with reference to FIG. 3B.

According to various embodiments, the bending structure may be used as a support member (e.g., a support) for contact of the coupling patch 320 and the radiating patch 330. The bending structures (e.g., the first bending structure 331, the second bending structure 332, the third bending structure 333, and the fourth bending structure 334) may be used to support the radiating patch 330 on the coupling patch 320. The bending surface of the bending structure may be disposed in the form of supporting the radiating patch 330 on the antenna PCB 310 and the coupling patch 320 by forming the bending surface such that the bending surface is substantially perpendicular to the surface of the plate. Because the radiating patch 330 may include a metal board and the bending structure is formed from the radiating patch 330, a metal column may be formed between the coupling patch 320 and the radiating patch 330. This is because the region corresponding to the cutting portion also is formed of a metallic object because the plate is a metallic portion.

According to various embodiments, the radiating patch 330 may be attached directly to the coupling part 320 through a surface mounted technology (SMT) scheme. A support structure between two layers may be realized by a separate support member, additional procedures such as production of a support member and soldering according to the material of the support member may be considered. However, because the bending structure according to various embodiments of the disclosure is a metallic structure formed by bending a portion of the plate of the radiating patch 330 including a metal without utilizing a separate support member, the bending structure may be attached directly to the coupling patch 320 in an SMT scheme. For example, because an additional procedure according to the production of the support member and the material of the support member according to various embodiments of the disclosure is omitted, production costs for the antenna module can be reduced. For example, because the accumulated process error may significantly influence performance in the communication equipment including a plurality of antenna modules, such as MMUs, an effect due to an easy SMT scheme can be maximized between metals without using any separate support member.

According to an embodiment, for a stable support, a cut portion, in addition to a portion that is connected to the plate and is folded, may be additionally bent. A bending surface that is parallel to the coupling patch 320 may be additionally formed by further bending one surface of the cut portion. That is, the bending structure may have an 'L' shape. A detailed description of the 'L' shape will be described below with reference to FIG. 3C.

According to various embodiments, the deployment and the shapes of the bending structures of the radiating patch 330 may be related to distribution of electric fields, in addition to the function of a support member. Because the bending structure is formed from a portion of the metal board of the radiation patch 330, from which a signal is radiated, the forming scheme influences the radiation performance of the antenna. The deployment of the bending structures may include at least one of a bending location, a cutting location, the number of the bending structures, and whether the cutting locations on the radiation surface are symmetrical to each other. The forms of the bending structures may include at least one of the number of bending, the shape of the bending surface, and the bending direction in each of the bending structure. Based on the deployment and the form of the bending structure, distributions of the electric fields may be different in an antenna resonance mode of the dual-polarized antenna. Accordingly, the CPR performance of the dual-polarized antenna may be different based on at which location in the space the bending structure is disposed and at which size the bending structure is formed. A detailed description of the deployment and the form of the bending structure will be described below with reference to FIGS. 7 and 8.

FIG. 3A illustrates as an example in which the radiating patch 330 has four bending structures, but the disclosure is not limited thereto. According to an embodiment, the radiating patch 330 may have one bending structure. Further, according to an embodiment, the radiating patch 330 may have two bending structures. It will be understood from the disclosure that any suitable number of bending structures may be employed.

Figure 3B:
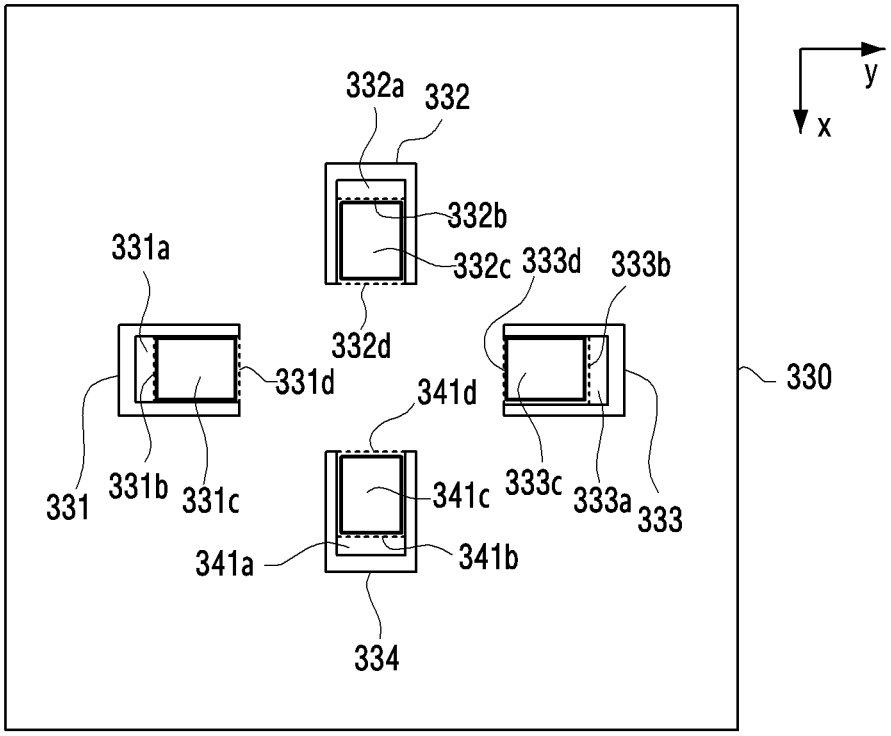
FIG. 3B is a plan view illustrating an example radiating patch according to various embodiments of the disclosure.

FIG. 3B is a plan view illustrating an example radiating patch 330 according to various embodiments of the disclosure. FIG. 3B is a diagram illustrating the radiating patch 330 of FIG. 3A viewed in the direction of the (−) z axis from the (+) z axis. The description according to the xyz coordinate of FIG. 3A may be shared in FIG. 3B.

Referring to FIG. 3B, the metal board for the radiating patch 330 may include a first bending structure 331, a second bending structure 332, a third bending structure 333, and a fourth bending structure 334. For a stable support, in each of the bending structures of FIG. 3B, a specific portion of the metal board of the radiating patch 330 may be cut and bent (hereinafter, primary bending), and the cut portion may be additionally bent (hereinafter, secondary bending). For example, the bending structure of the radiating patch 330 may be attached to the coupling patch 320 in an L shape.

A bending surface of the cut portion of the metal board of the radiating patch 330 according to the primary bending may be used as a support member (e.g., a short pin) of the radiating patch 330. Accordingly, the cut surface according to the primary bending may be referred to as a support bending surface. A bending line between the support bending surface and the metallic plate of the radiating patch 330 may be referred to as a support bending line. A surface of the support bending surface, which faces the surface attached to the coupling patch 320 according to the secondary bending may be referred to as an attachment bending surface. A surface that faces the attachment bending surface, for example, an opposite surface may be attached to the coupling patch 320.

Further, the bending line for the secondary bending may be referred to as an attachment bending line. The first bending structure 331 may include an attachment bending surface 331*a*, an attachment bending line 331*b*, a support bending surface 331*c*, and a support bending line 331*d*. The second bending structure 332 may include an attachment bending surface 332*a*, an attachment bending line 332*b*, a support bending surface 332*c*, and a support bending line 332*d*. The third bending structure 333 may include an attachment bending surface 333*a*, an attachment bending line 333*b*, a support bending surface 333*c*, and a support bending line 333*d*. The fourth bending structure 334 may include an attachment bending surface 334*a*, an attachment bending line 334*b*, a support bending surface 334*c*, and a support bending line 334*d*.

Figure 3C:
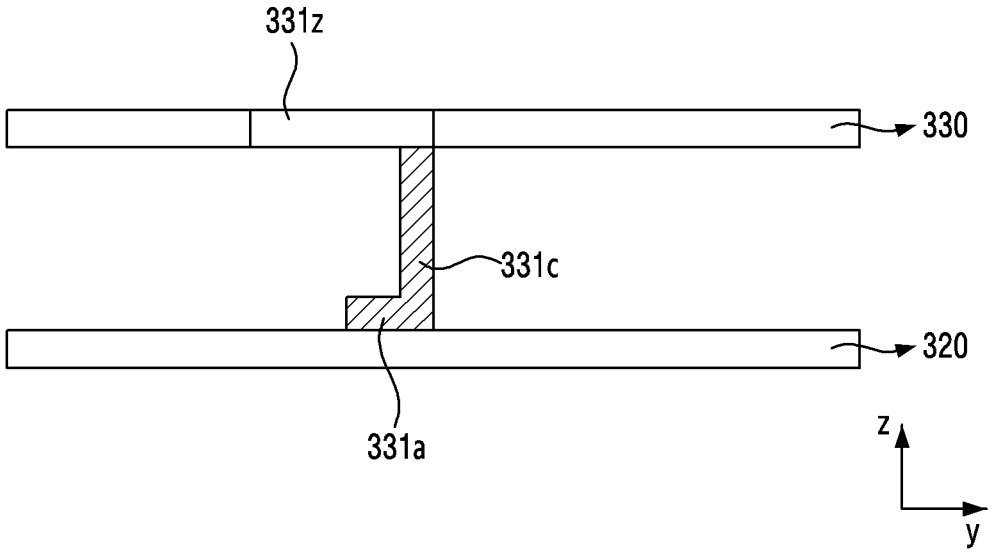
FIG. 3C is a front view illustrating an example bending structure of a radiating patch according to various embodiments of the disclosure.

FIG. 3C is a diagram illustrating an example of a front view of a bending structure of a radiating patch 330 according to various embodiments of the disclosure. FIG. 3C is a view when the antenna module 300 of FIG. 3A is viewed in the direction of the (−) x axis from the (+) x axis. The description according to the xyz coordinate system of FIG. 3A and the description according to the xy coordinate system of FIG. 3B may be shared in FIG. 3C. A first bending structure 331 is illustrated, by way of example, as the bending structure.

Referring to FIG. 3C, the first bending structure 331 may be formed by cutting one region 331*z* of the metal board of the radiating patch 330. The one region 331*z* may be referred to as a cutting region. Because the radiating patch 330 is a metal board, the cutting region may be a metallic object, for example, a conductor. In order to form a stack structure of the radiating patch 330 and the coupling patch 320, the one region 331*z* of the radiating patch 330 may be attached to the coupling patch 320 and may be utilized as a support member of the radiating patch 330. The one region 331*z* may include a support bending surface 331*c* formed through the primary bending on the metal board and an attachment bending surface 331*a* may be formed through the additional secondary bending.

Meanwhile, FIGS. 3B and 3C illustrate that a surface that faces the attachment bending surface is disposed in the coupling patch 320, but the embodiments of the disclosure are not limited thereto. According to an embodiment, in the case of the secondary bending, the folding direction may be opposite. For example, instead of forming a cutting surface 331*a* in the (−) y axis direction of FIG. 3C, a bending surface may be formed by bending the metal board in the (+) y axis direction. The attachment bending surface 331*a* of FIG. 3B may be disposed directly in the coupling plate 320.

Figure 4:
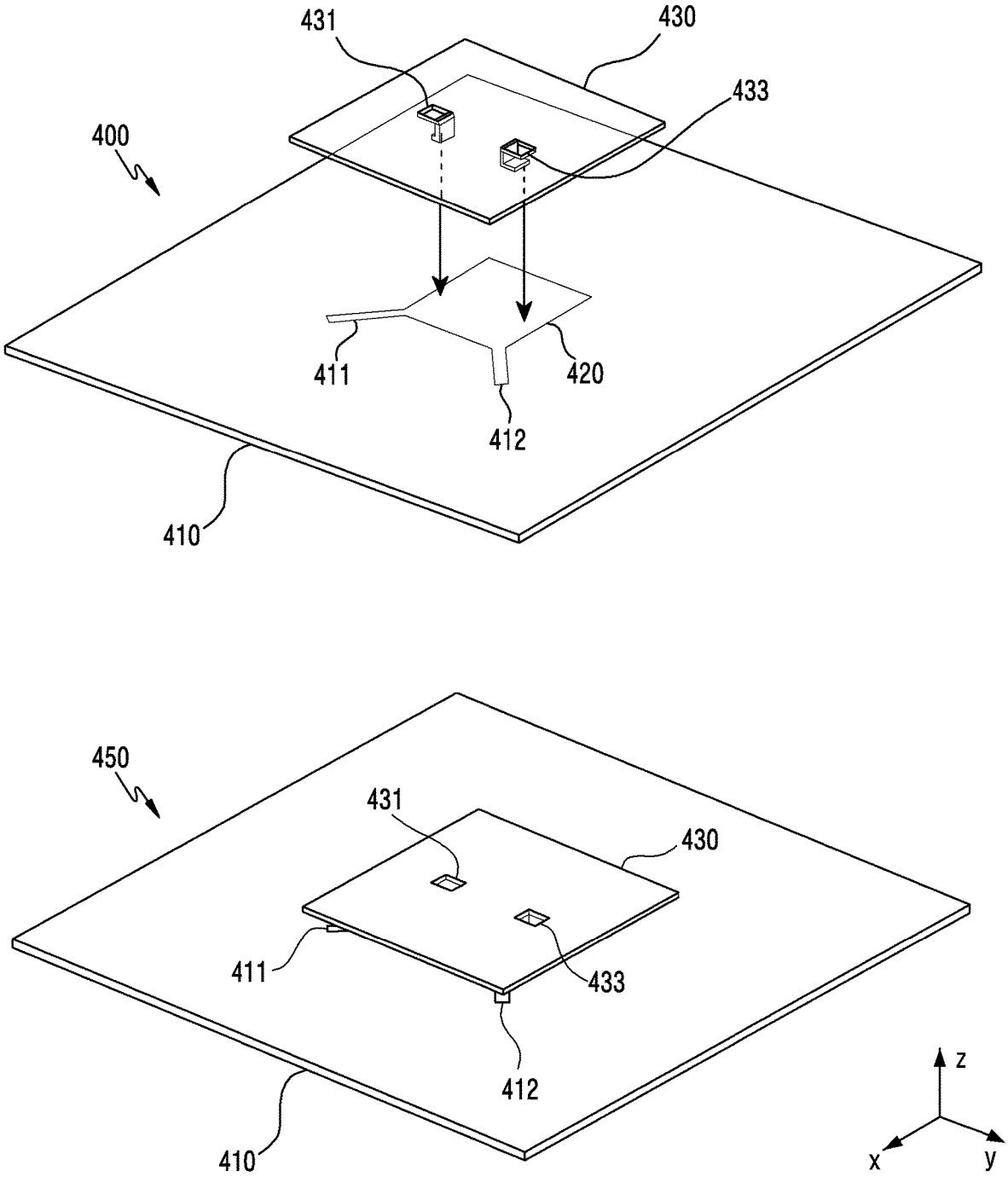
FIG. 4 is a diagram illustrating another example antenna module including a bending structure of a radiating patch according to various embodiments of the disclosure.

FIG. 4 is a diagram illustrating another example of an antenna module including a bending structure of a radiating patch 430 according to various embodiments of the disclosure. FIG. 4 illustrates an example in which the radiating patch 300 includes two bending structures unlike FIG. 3A.

Referring to FIG. 4, the exploded view 400 illustrates individual components of the antenna module, and the assembly view 450 illustrates the assembled antenna module. The antenna module may include an antenna PCB 410, a first antenna port 411, a second antenna port 412, a coupling patch 420, a radiating patch 430, and a feeding line (or feeding lines) (not illustrated) connected to the antenna ports. The antenna PCB 410, the first antenna port 411, the second antenna port 412, the coupling patch 420, and the radiating patch 430 correspond to the antenna PCB 310, the first antenna port 311, the second antenna port 312, the coupling patch 320, and the radiating patch 330 of FIG. 3A, respectively, and thus the same or similar description thereof may not be repeated here.

According to various embodiments, the radiating patch 430 may be disposed to be spaced apart from the coupling patch 320 by a specific interval. The radiating patch 430 may radiate a signal of the first antenna port 411 and a signal of the second antenna port 412 provided from the coupling patch to air. The radiating patch 330 may include a metal board. According to various embodiments, the radiating patch 430 may have at least one bending structure. For example, as four specific portions on a surface of the radiating patch 330, which is perpendicular to the z axis are cut and folded, a first bending structure 431 and a second bending structure 433 of the radiating patch 330 may be formed.

According to various embodiments, the bending structure may be used as a support member for contact of the coupling patch 420 and the radiating patch 430. The bending structures (e.g., the first bending structure 431 and the second bending structure 433) may be used to support the radiating patch 330 on the coupling patch 420. Then, because the radiating patch 430 is a metal board and the bending structure is formed by cutting the radiating patch 430, a metal column may be formed between the coupling patch 420 and the radiating patch 430. The radiating patch 430 may be attached directly to the coupling patch 420 via an SMT scheme. For a stable support, a cut portion, in addition to a portion that is connected to the plate and is folded, may be additionally bent. An opposite surface of the bending surface formed from the additional bending may be attached to the coupling patch 420.

Figure 5:
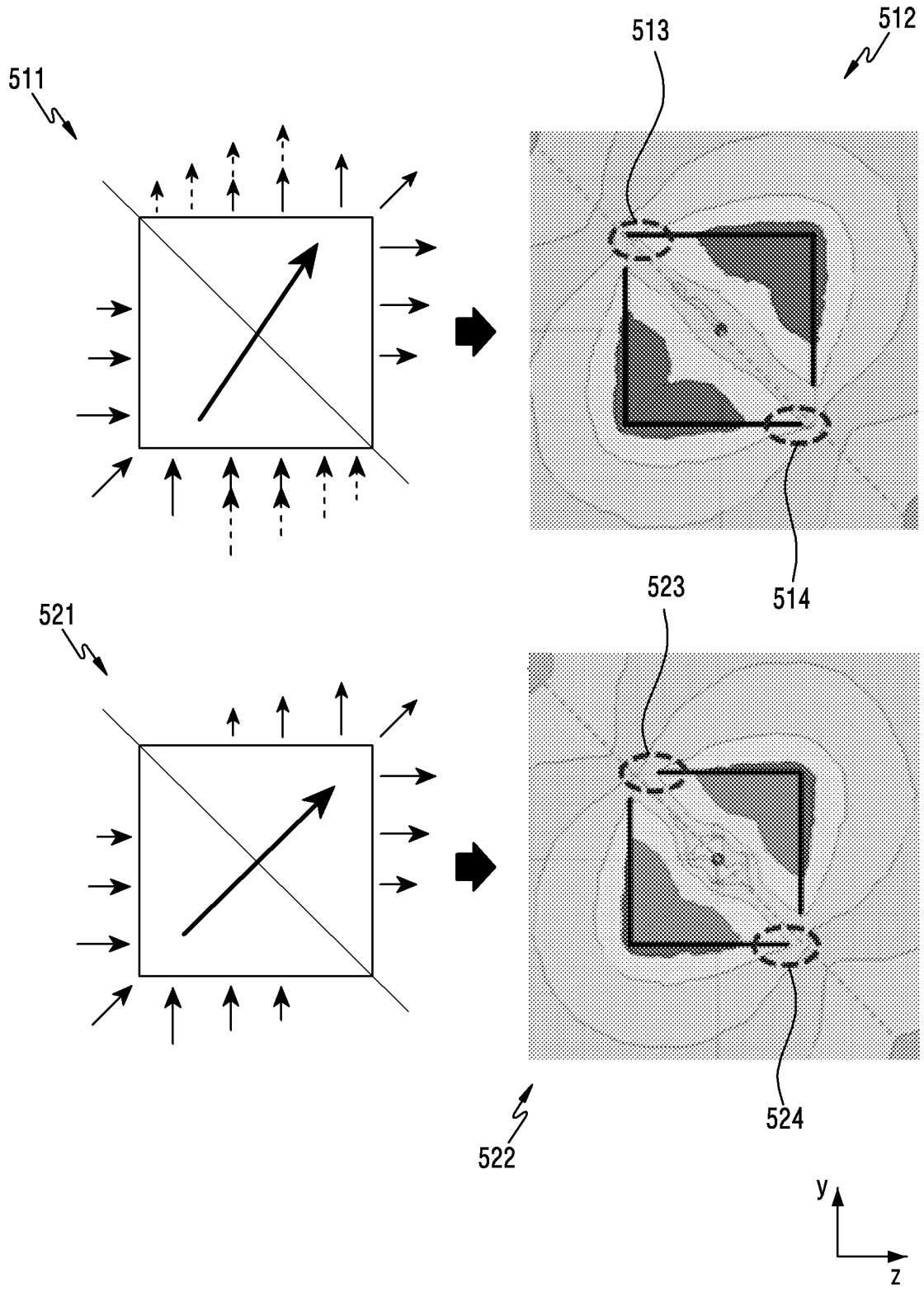
FIG. 5 is a diagram illustrating an example relationship between a symmetry and a CPR according to various embodiments of the disclosure.

FIG. 5 is a diagram illustrating an example relationship between a symmetry and a CPR according to various embodiments of the disclosure. In order to describe the symmetry, a +45° polarization and a −45° polarization are illustrated, by way of example, as two different polarizations.

The polarization characteristics of the antenna are determined by a vector sum of the electric fields of the antenna. The signal radiated from the antenna may include a plurality of vectors. The plurality of vectors may be detected from a change in the intensity of the electric field. As the distribution of the vectors detected from the electric field is symmetrical with respect to the polarization direction, the components of the signal of another polarization component may become smaller in the signal for a specific polarization. If a signal for the +45° polarization is radiated, only the +45° polarization should be detected. However, the actually radiated signal may include a component that is not desired, and the vector for the component that is not desired in the electric field may cause asymmetry. Accordingly, the symmetry of the distribution of the electric field may directly represent the CPR performance of the antenna. Hereinafter, a situation in which a signal for a +45° polarization will be described.

Referring to FIG. 5, a first vector diagram 511 represents the vectors for the +45° polarization in an existing antenna module, and a first electric field pattern 512 represents an electric field for the +45° polarization in the existing antenna module. Hereinafter, the following table may be referenced for the electric field pattern in the disclosure. The highest contour line corresponds to level 16.

TABLE 1

| Level | Intensity |
|---|---|
| Level 16 | 1.2021 E4 |
| Level 15 | 6.5942 E3 |
| Level 14 | 3.5681 E3 |
| Level 13 | 1.9440 E3 |
| Level 12 | 1.0591 E3 |
| Level 11 | 5.7702 E2 |
| Level 10 | 3.1437 E2 |
| Level 9 | 1.7127 E2 |
| Level 8 | 9.3312 E1 |
| Level 7 | 5.0838 E1 |
| Level 6 | 2.7697 E1 |
| Level 5 | 1.5090 E1 |
| Level 4 | 8.2213 E0 |
| Level 3 | 4.4791 E0 |
| Level 2 | 2.4403 E0 |
| Level 1 | 1.3295 E0 |

The vector sum of the first vector diagram 511 indicates 45+α° (α>0). That is the signal for the +45° polarization is output counterclockwise from the +45° direction, that is, by 45+α° (α>0). If the ends of the contour lines are connected to each other in the first electric field pattern 512, the asymmetry for the +45° may be identified. The fact that the first end point 513 and the second end point 514 are formed longer than the other end points may refer, for example, to an additional vector component being present in the corresponding direction. A symmetric reference line may be formed in the first electric field pattern 512 at 45+α° (α>0), but the symmetry for +45° cannot be satisfied.

The second vector diagram 511 represents the vectors for the +45° polarization in the antenna module including the bending structure according to various embodiments of the disclosure, and the second electric field pattern 522 represents an electric field for a signal for the +45° polarization of the antenna module including the bending structure according to various embodiments of the disclosure. The vector sum of the second vector diagram 521 indicates 45. That is, the signal fort the +45° polarization is output substantially by 45°. If the ends of the contour lines are connected to each other in the second electric field pattern 522, the symmetry for the +45° may be identified. Because the third end point 523 and the fourth end point 524 are formed to be symmetrical to the other end points, unlike in the first electric field pattern 512, the symmetry reference line of the second electric field pattern 522 may be formed at +45°. As the symmetry is satisfied, the cross-pol component of the signal having the +45° polarization can be reduced, and thus the CPR performance can be improved.

Figure 6:
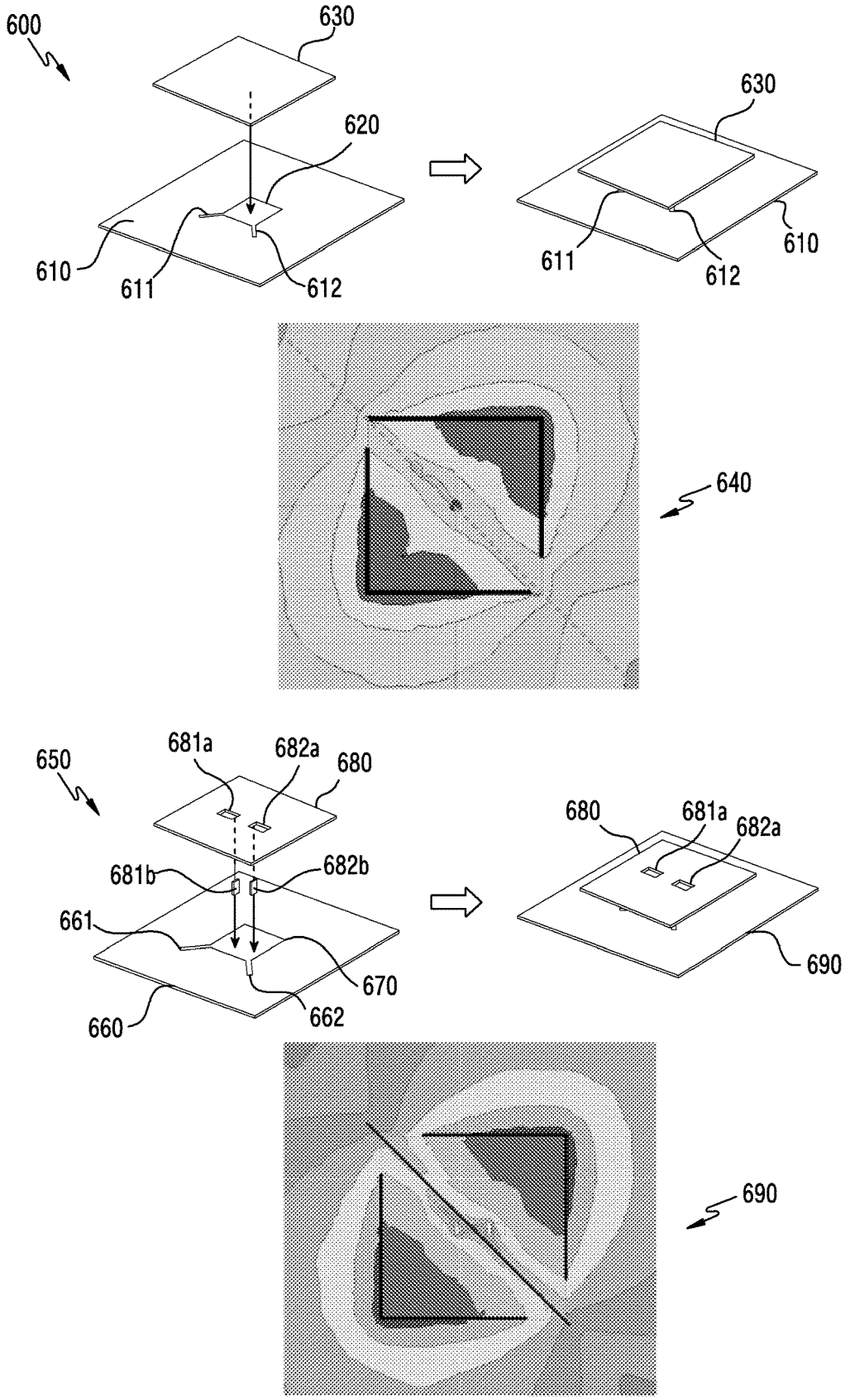
FIG. 6 is a diagram illustrating an example of improvement of a CPR of an antenna module including a bending structure of a radiating patch according to various embodiments of the disclosure.

FIG. 6 is a diagram illustrating an example of improvement of a CPR of an antenna module 650 including a bending structure of a radiating patch according to various embodiments of the disclosure. In order to describe the bending structure and the performance of the antenna module 650 according to various embodiments, an example of the antenna module 600 with no bending structure will be described.

Referring to FIG. 6, the antenna module 600 may include an antenna PCB 610, a first antenna port 611, a second antenna port 612, a coupling patch 620, a radiating patch 630, and a feeding line (or feeding lines) (not illustrated) connected to the antenna ports. The radiating patch 630 uses one metal board for radiation, but does not have a separate bending structure. Because the antenna module 600 does not have a bending structure, the separation degrees for different polarization components may be relatively low. The electric field pattern 640 represents an electric field for the first antenna port 611 of the antenna module 600, that is, the +45° polarization. Because the electric field pattern 640 is asymmetric with respect to the +45° direction, the antenna module 600 may have a relatively low CPR as compared with the antenna module 650 including the bending structure, which will be described below.

The antenna module 650 may include an antenna PCB 660, a first antenna port 661, a second antenna port 662, a coupling patch 670, a radiating patch 680, and a feeding line (or feeding lines) (not illustrated) connected to the antenna ports. The description of the components of the antenna module 650 of FIG. 6 at least partially corresponds to the components of the antenna module of FIG. 3A or 4, and thus the same or similar descriptions may not be repeated here.

The radiating patch 680 may have two bending structures including two cutting portions (or may be referred to as cutting regions) in one metal board. The two cutting portions may include a first cutting portion 681*a* and a second cutting portion 682*a*. The first cutting portion 681*a* may correspond to the first bending structure 681*b*. The second cutting portion 682*a* may correspond to the second bending structure 682*b*. The first bending structure 681*b* and the second bending structure 682*b* may perform the functions of metallic columns that connect the coupling patch 670 and the radiating patch 680.

According to various embodiments of the disclosure, the asymmetry problem of the polarization component mentioned in FIG. 5 may be controlled by arranging the first cutting portion 681*a* and the second cutting portion 682*a*. That is, the first cutting portion 681*a* and the second cutting portion 682*a* may be disposed such that an electric field of a signal of an antenna for a specific polarization is symmetrical by designing the antenna module 650 such that a portion of the vector components of the electric field formed in the radiation patch is restrained or a signal of a component of the opposite direction is supplied. According to an embodiment, the cutting portion may be disposed based on the experimental values. Further, according to an embodiment, the cutting portions may be flexibly disposed according to the acquired electric field pattern. For example, the cutting portion may be disposed on a radiation surface of the radiating patch as if it were not cut, or may be removed for control of CPR. Further, for example, the cutting portion may be used to additionally support the support member using the already cut portion instead of removing the cutting portion. The electric field pattern 690 represents an electric field for the first antenna port 661 of the antenna module 650, that is, the +45° polarization. Because the electric field pattern 690 is symmetric with respect to the +45° direction, the antenna module 650 may have a relatively high CPR as compared with the antenna module 650 that does not include the above-described bending structure.

Via FIGS. 3A, 3B, 3C, 4, 5 and 6, a measure for easily improving the CPRs of the support structure between the radiating patch and the coupling patch, and the dual-polarized antenna by using the bending structure formed by cutting at least one region of the radiating patch. Hereinafter, embodiments illustrating an example relationship the deployment and the form of the bending structure and the improvement of the CPR will be described via FIGS. 7 and 8.

Figure 7:
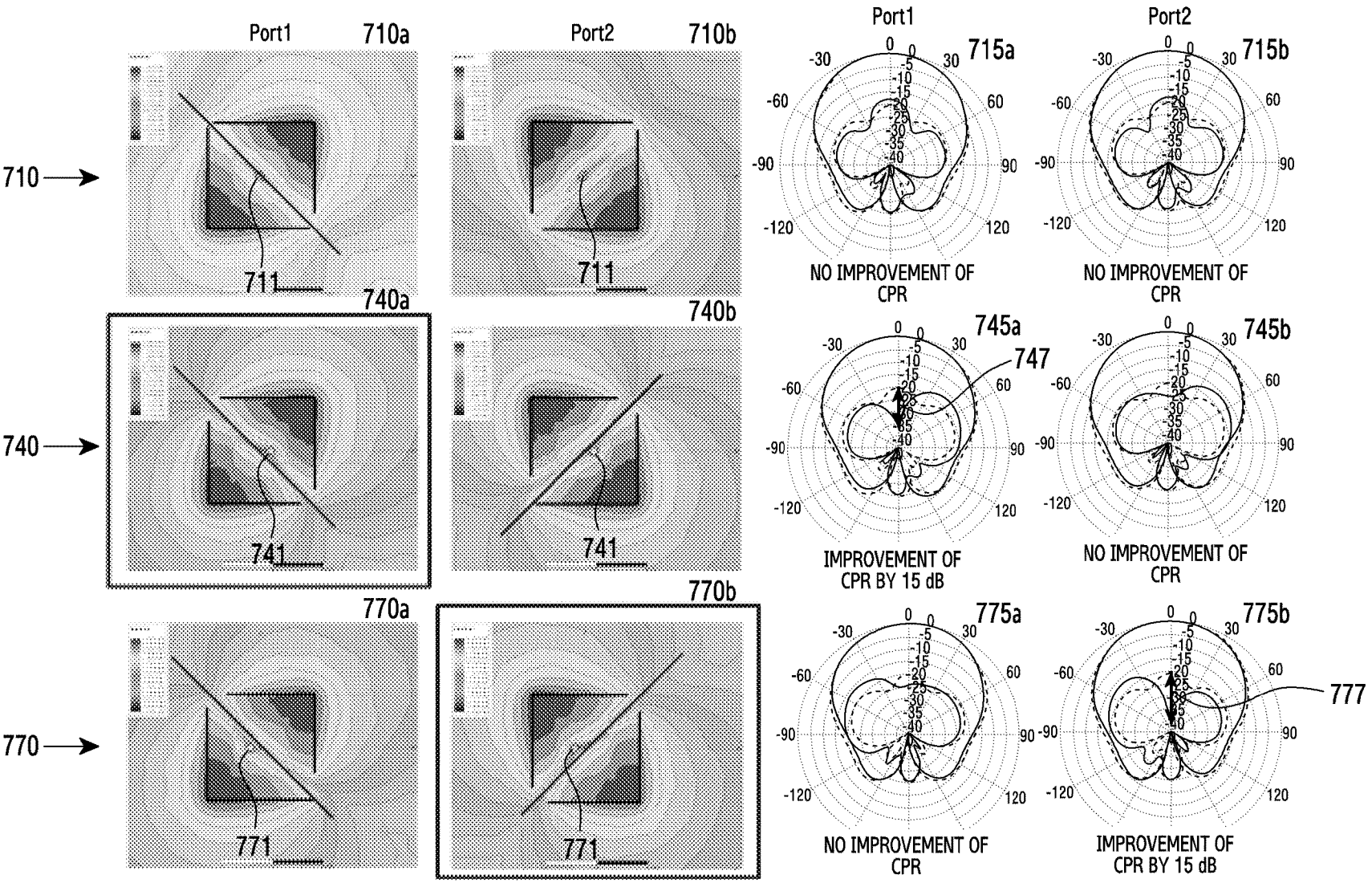
FIG. 7 is a diagram illustrating an example of a change in a CPR of performance according to a location of a bending structure of a radiating patch according to various embodiments of the disclosure.

FIG. 7 is a diagram illustrating an example of a change in a CPR of performance according to a location of a bending structure of a radiating patch according to various embodiments of the disclosure. The antenna module of FIG. 7, as illustrated in FIGS. 3A, 3B, 3C, 4, 5 and 6, may include an antenna PCB, a coupling patch, a radiating patch, a first antenna port for a first polarization, and a second antenna port for a second polarization. To determine improvement of performance according to the deployment of the bending structure, a measurement was performed on the antenna module having one bending structure. In order to describe the bending structure and the improvement of the performance of the antenna module according to various embodiments, an example of the antenna module 600 with no bending structure will be described via comparison. When the electric field pattern 640 is considered, the output of the signal for the +45° polarization in the antenna module 600 may be an about $+45+\alpha°$ direction ($\alpha>0$). in the antenna module 600, the output of the signal for the −45° polarization may be an about $-45+\beta°$ direction ($\beta>0$).

Referring to FIG. 7, in the first case 710, the antenna module includes a bending structure formed at a central location 711 of the radiating patch. The end points of the contour lines of the electric field pattern 710*a* for the first antenna port form asymmetry with respect to the +45° direction. It is identified that there is no increase in the difference between the co-pol characteristics and the cross-pol characteristics of the radiation pattern 715*a* for the first antenna port. Because the central location of the radiating patch is a physically symmetric location, it may not be helpful to actually dispose the bending structure at the central location in an aspect of the improvement of CPR. The end points of the contour lines of the electric field pattern 710*b* for the second antenna port form asymmetry with respect to the −45° direction. It is identified that there is no increase in the difference between the co-pol characteristics and the cross-pol characteristics of the radiation pattern 715*b* for the second antenna port. Because the central location of the radiating patch is a physically symmetric location, it may not be helpful to actually dispose the bending structure at the central location in an aspect of the improvement of CPR.

In the second case 740, the antenna module includes a bending structure formed on the right side 741 of the central location of the radiating patch. The end points of the contour lines of the electric field pattern 740*a* for the first antenna port form symmetry with respect to the +45° direction. It is identified that there is an increase 747 of about 15 dB in the difference between the co-pol characteristics and the cross-pol characteristics of the radiation pattern 745*a* for the first antenna port. In FIG. 6, the antenna module having no bending structure provides a vector sum in the $+45+\alpha°$ direction. However, because the component in the $+45+\alpha°$ direction (that is, counterclockwise) is reduced according to the cutting regions located on the lower and right sides of the +45° direction on the radiating patch, the symmetry can be increased. Due to the high symmetry, the CPR performance can be increased.

The end points of the contour lines of the electric field pattern 740*b* for the second antenna port form asymmetry with respect to the −45° direction. It is identified that there is an increase in the difference between the co-pol characteristics and the cross-pol characteristics of the radiation pattern 745*b* for the second antenna port. In FIG. 6, the antenna module having no bending structure provides a vector sum in the −45+β° direction. The asymmetry can be increased because the component in the −45+β° direction can be rather increased according to the cutting regions located on the upper and rightward direction (that is, the clockwise direction) with respect to the −45° direction on the radiating patch.

In the third case 770, the antenna module includes a bending structure formed on the left side 771 of the central location of the radiating patch. The end points of the contour lines of the electric field pattern 770*a* for the first antenna port form symmetry with respect to the +45° direction. It is identified that there is an increase in the difference between the co-pol characteristics and the cross-pol characteristics of the radiation pattern 775*a* for the first antenna port. In FIG. 6, the antenna module having no bending structure provides a vector sum in the +45+α° direction. The asymmetry can be increased because the component in the +45+α° direction can be rather increased according to the cutting regions located on the upper and leftward direction with respect to the +45° direction on the radiating patch.

The end points of the contour lines of the electric field pattern 770*b* for the second antenna port form symmetry with respect to the −45° direction. It is identified that there is an increase 777 of about 15 dB in the difference between the co-pol characteristics and the cross-pol characteristics of the radiation pattern 745*b* for the second antenna port. In FIG. 6, the antenna module having no bending structure provides a vector sum in the −45+β° direction. However, because the component in the −45+β° direction (that is, counterclockwise) is reduced according to the cutting regions located on the lower and left sides of the +45° direction on the radiating patch, the symmetry can be increased. Due to the high symmetry, the CPR performance can be increased.

As discussed via FIG. 7, the location of a suitable bending structure may be designed according to the vector characteristics of the initial antenna ports. For example, a default value of an antenna port for the +45° polarization represents a vector sum of +45+α°, a cutting region of the radiating patch may be formed on the right side of the center and the bending structure may be disposed as in the second case 740. Further, it may not be preferable to improve the CPR of only one polarization in an aspect of delivery of a signal. As in the third case 770, in order to improve the CPR of an antenna port for the −45° polarization, a cutting region of the radiating patch is additionally formed on the left side of the central location, and the bending structure for the corresponding cutting region may be disposed. The two bending structures disposed on opposite sides of the center may be realized as in FIG. 4.

An excessively wide cutting region decreases the original radiating patch region, and thus deteriorates the radiation function. Accordingly, a minimum and/or reduced area may be necessary to form a bending structure from the cutting region. Because a vector sum is greatly influenced as the vector sum deviates horizontally from the center of the vector sum formed by the radiating patch, a patch design that satisfies an antenna requirement from a smaller cutting region may be made as the vector sum becomes farther from the center. According to various embodiments, the cutting region (or the bending structure) of the radiating patch may be disposed based on the vector characteristics of the antenna element. According to an embodiment, the size of the cutting region may be determined based on a distance, by which the cutting region is spaced apart from the center of the radiating patch, for example, the spacing distance. Similarly, the length of the support part of the bending structure that connects the radiating patch and the coupling patch may be determined based on the distance, by which the cutting region is spaced apart from the center of the radiating patch, that is, the spacing distance.

Figure 8:
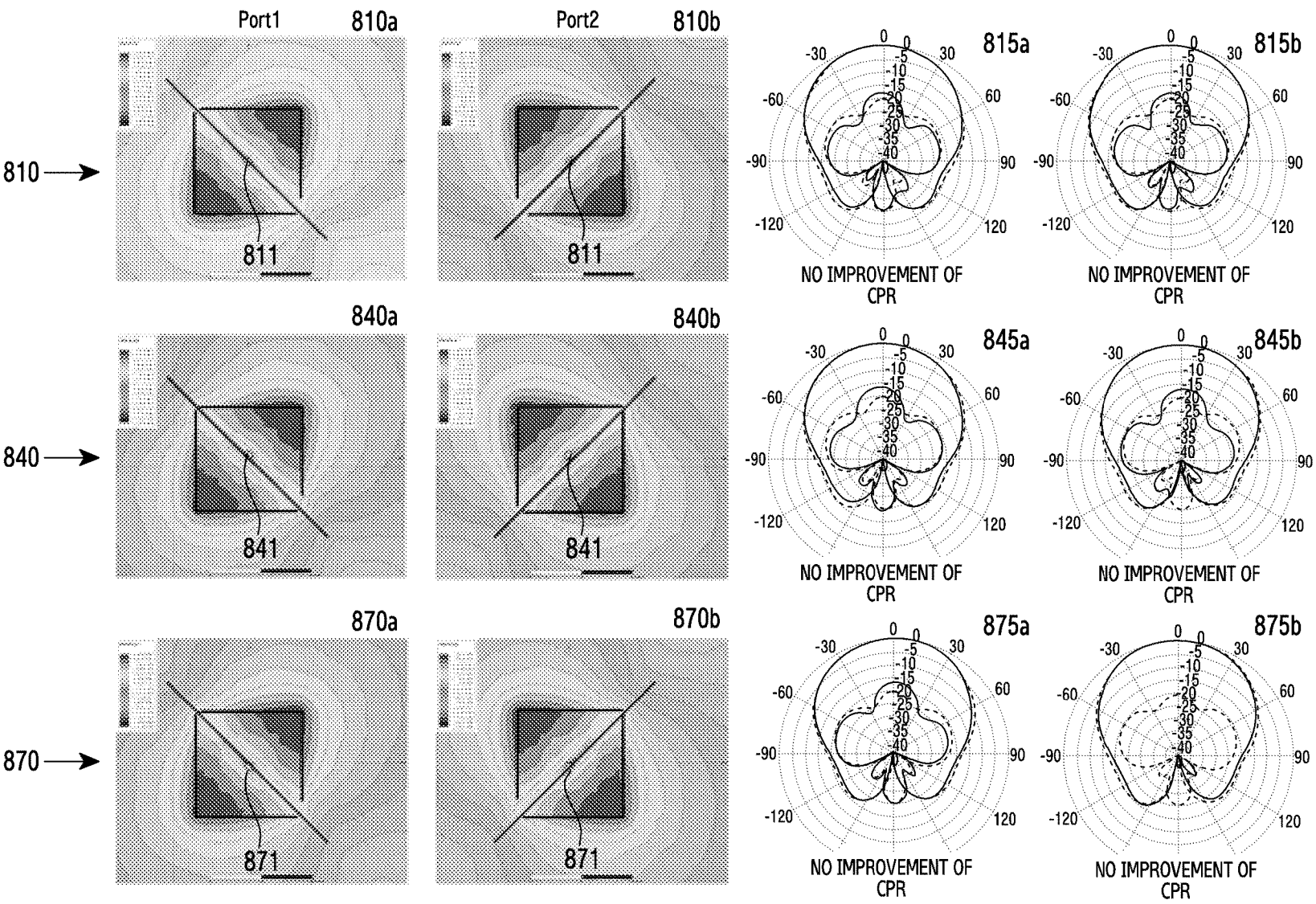
FIG. 8 is a diagram illustrating another example of a change in a CPR of performance according to a location of a bending structure of a radiating patch according to various embodiments of the disclosure.

FIG. 8 is a diagram illustrating another example of a change in a CPR of performance according to a location of a bending structure of a radiating patch according to various embodiments of the disclosure. The antenna module of FIG. 8, as illustrated in FIGS. 3A to 6, may include an antenna PCB, a coupling patch, a radiating patch, a first antenna port for a first polarization, and a second antenna port for a second polarization. Meanwhile, in order to determine improvement of performance according to the deployment of the bending structure, a measurement was performed on the antenna module having one bending structure. In order to describe the bending structure and the improvement of the performance of the antenna module according to various embodiments, an example of the antenna module 600 with no bending structure will be described through comparison. When the electric field pattern 640 is considered, the output of the signal for the +45° polarization in the antenna module 600 may be an about +45+α° direction (α>0). In the antenna module 600, the output of the signal for the −45° polarization may be an about −45+β° direction (β>0).

Referring to FIG. 8, in the first case 810, the antenna module includes a bending structure formed at a central location 811 of the radiating patch. The end points of the contour lines of the electric field pattern 810*a* for the first antenna port form asymmetry with respect to the +45° direction. It is identified that there is an increase in the difference between the co-pol characteristics and the cross-pol characteristics of the radiation pattern 815*a* for the first antenna port. Because the central location of the radiating patch is a physically symmetric location, it may not be helpful to actually dispose the bending structure at the central location in an aspect of the improvement of CPR. The end points of the contour lines of the electric field pattern 810*b* for the second antenna port form asymmetry with respect to the −45° direction. It is identified that there is an increase in the difference between the co-pol characteristics and the cross-pol characteristics of the radiation pattern 815*b* for the second antenna port. Because the central location of the radiating patch is a physically symmetric location, it may not be helpful to actually dispose the bending structure at the central location in an aspect of the improvement of CPR.

In the second case 840, the antenna module includes a bending structure formed on the upper side 841 of the central location of the radiating patch. The end points of the contour lines of the electric field pattern 840*a* for the first antenna port form symmetry with respect to the +45° direction. It is identified that there is an increase in the difference between the co-pol characteristics and the cross-pol characteristics of the radiation pattern 845*a* for the first antenna port. In FIG. 6, the antenna module having no bending structure provides a vector sum in the +45+α° direction. The cutting region is located on the upper side of the +45° on the radiating patch.

However, because the direction (clockwise or counterclockwise) of the vector sum is hardly influenced even if the vector component of the corresponding cutting region is eliminated, it may not be helpful for the improvement of the CPR of the bending structure disposed on the upper side.

The end points of the contour lines of the electric field pattern 840*b* for the second antenna port form asymmetry with respect to the −45° direction. It is identified that there is an increase in the difference between the co-pol characteristics and the cross-pol characteristics of the radiation pattern 845*b* for the second antenna port. In FIG. 6, the antenna module having no bending structure provides a vector sum in the −45+β° direction. The cutting region is located on the upper side of the −45° on the radiating patch. However, because the direction (clockwise or counterclockwise) of the vector sum is hardly influenced even if the vector component of the corresponding cutting region is eliminated, it may not be helpful for the improvement of the CPR of the bending structure disposed on the upper side.

In the third case 870, the antenna module includes a bending structure formed on the lower side 871 of the central location of the radiating patch. The end points of the contour lines of the electric field pattern 870*a* for the first antenna port form asymmetry with respect to the +45° direction. It is identified that there is an increase in the difference between the co-pol characteristics and the cross-pol characteristics of the radiation pattern 875*a* for the first antenna port. In FIG. 6, the antenna module having no bending structure provides a vector sum in the +45+α° direction. The cutting region is located on the lower side of the +45° on the radiating patch. However, because the direction (clockwise or counterclockwise) of the vector sum is hardly influenced even if the vector component of the corresponding cutting region is eliminated, it may not be helpful for the improvement of the CPR of the bending structure disposed on the lower side.

The end points of the contour lines of the electric field pattern 870*b* for the second antenna port form asymmetry with respect to the −45° direction. It is identified that there is an increase in the difference between the co-pol characteristics and the cross-pol characteristics of the radiation pattern 845*b* for the second antenna port. In FIG. 6, the antenna module having no bending structure provides a vector sum in the −45+β° direction. The cutting region is located on the lower side of the −45° on the radiating patch. However, because the direction (clockwise or counterclockwise) of the vector sum is hardly influenced even if the vector component of the corresponding cutting region is eliminated, it may not be helpful for the improvement of the CPR of the bending structure disposed on the lower side.

Because the vector sum cannot be greatly influenced even if the vector sum deviates from the center of the vector sum formed by the radiating patch, the designer of the antenna module may consider the direction from the center of the radiating patch in addition to the size of the cutting region (or the bending structure) and the distance from the center of the radiating patch. According to various embodiments, the cutting region (or the bending structure) of the radiating patch may be disposed based on the vector characteristics of the antenna element. According to an embodiment, the size of the cutting region may be determined based on at least one of a distance, by which the cutting region is spaced apart from the center of the radiating patch, the spacing distance, and the spacing direction. Similarly, the length of the support part of the bending structure that connects the radiating patch and the coupling patch may be determined based on at least one of the distance, by which the cutting region is spaced apart from the center of the radiating patch, the spacing distance, and the spacing direction.

Figure 9:
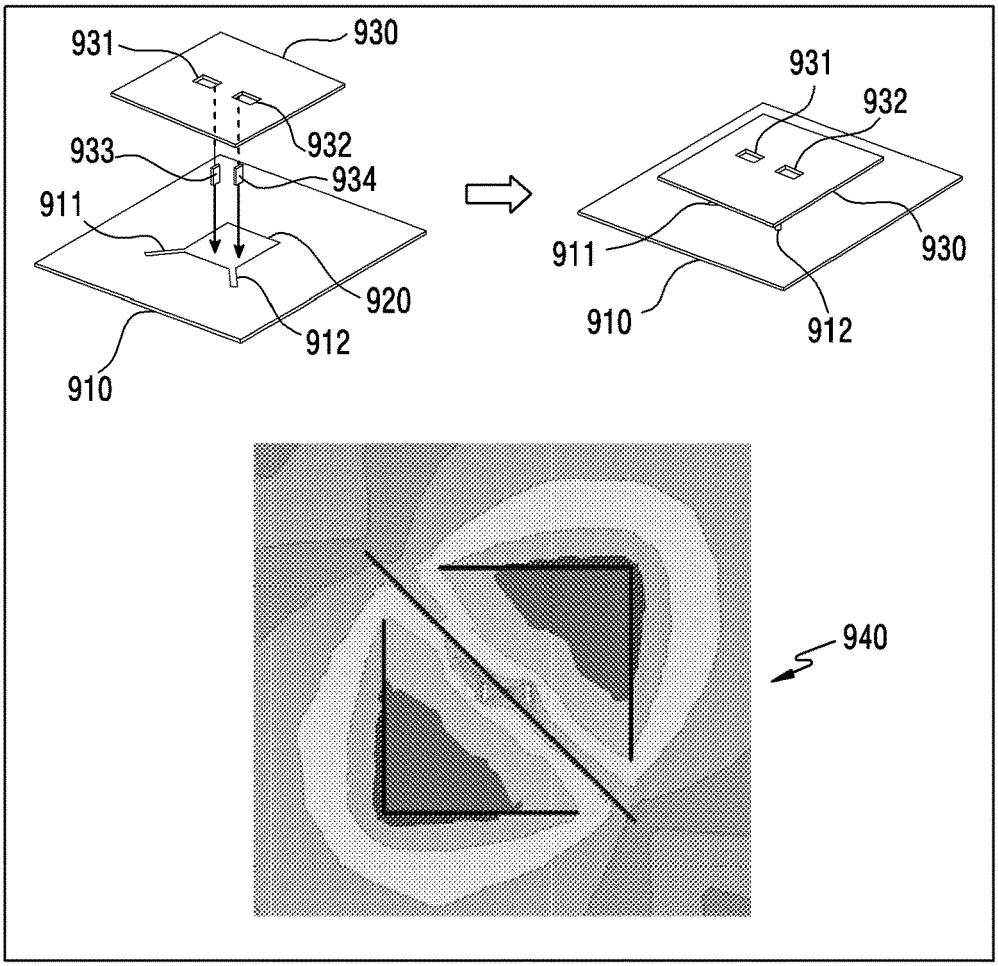
FIG. 9 is a diagram illustrating an example of improvement of a CPR performance of an antenna module including a bending structure of a radiating patch according to various embodiments of the disclosure.
Figure 9:
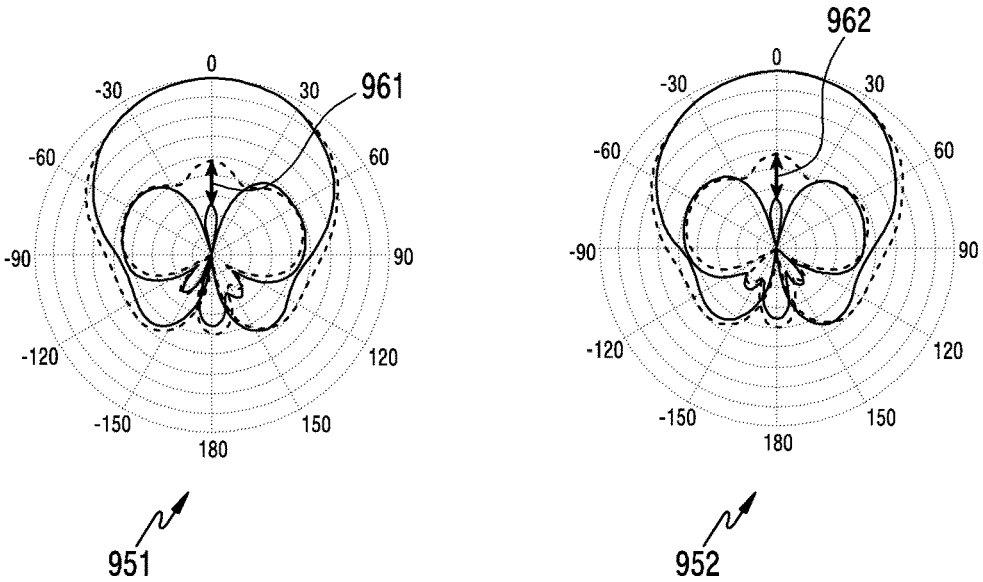

FIG. 9 is a diagram illustrating an example of improvement of a CPR performance of an antenna module including a bending structure of a radiating patch according to various embodiments of the disclosure; and Referring to FIG. 9, the antenna module 900 may include an antenna PCB 910, a first antenna port 911, a second antenna port 912, a coupling patch 920, a radiating patch 930, and a feeding line (or feeding lines) (not illustrated) connected to the antenna ports. The description of the components of the antenna module of FIG. 9 at least partially corresponds to the components of the antenna module of FIG. 4, and thus the same or similar descriptions may not be repeated here. The radiating patch 930 may have two cutting portions (or may be referred to as cutting regions) and two bending structures in one metal board. The two cutting portions may include a first cutting portion 931 and a second cutting portion 932. The first cutting portion 931 may correspond to the first bending structure 933. The second cutting portion 932 may correspond to the second bending structure 934. The first bending structure 933 and the second bending structure 934 may perform the functions of metallic columns that connect the coupling patch 920 and the radiating patch 930.

Referring to the electric field pattern 940, it may be identified that symmetry is satisfied unlike the electric field pattern 640 of FIG. 6. The first radiation pattern 951 represents improvement of the CPR performance of the first antenna port (that is, the first antenna component) for the first polarization. It is identified that the difference 961 between the co-pol component and the cross-pol component of the signal radiated through the first antenna port is increased by about 12 dB as compared with the case in which there is no bending structure. The second radiation pattern 952 represents improvement of the CPR performance of the second antenna port (that is, the second antenna component) for the second polarization. It is identified that the difference 962 between the co-pol component and the cross-pol component of the signal radiated through the second antenna port is increased by about 12 dB as compared with the case in which there is no bending structure.

Figure 10:
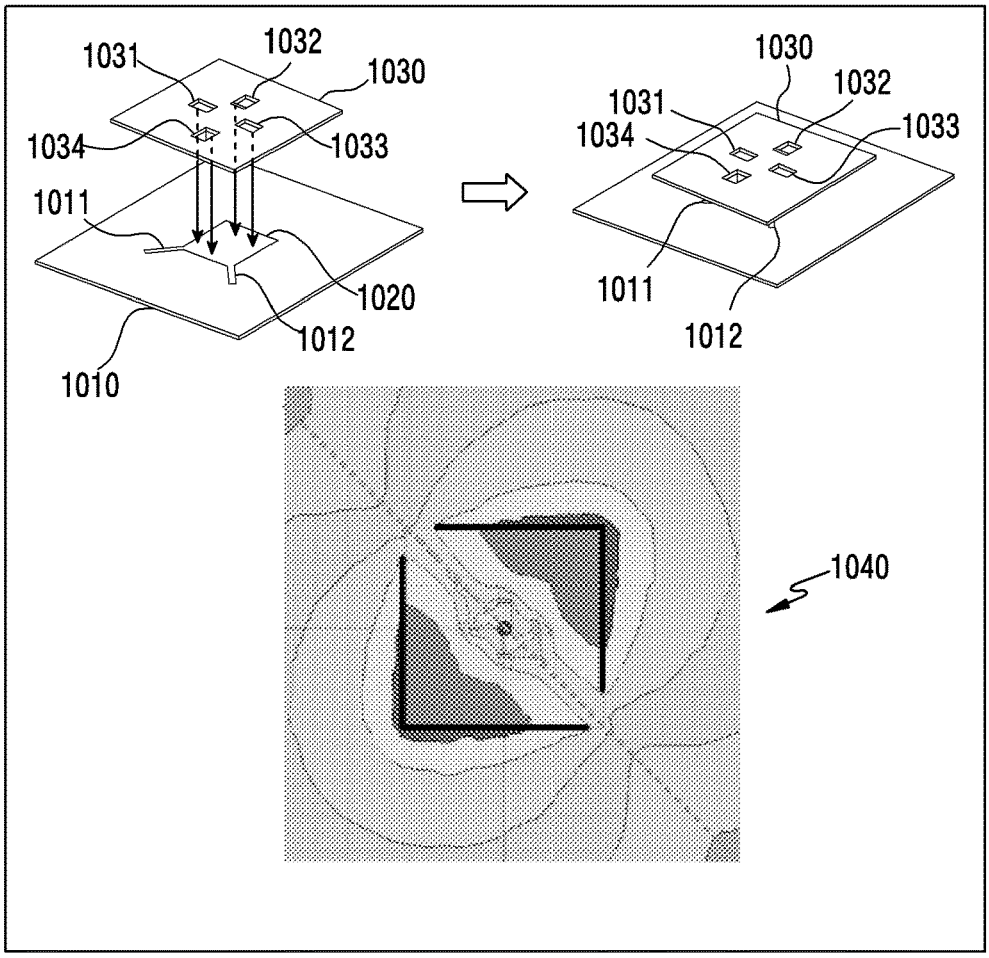
FIG. 10 is a diagram illustrating another example of improvement of a CPR performance of an antenna module including a bending structure of a radiating patch according to various embodiments of the disclosure.
Figure 10:
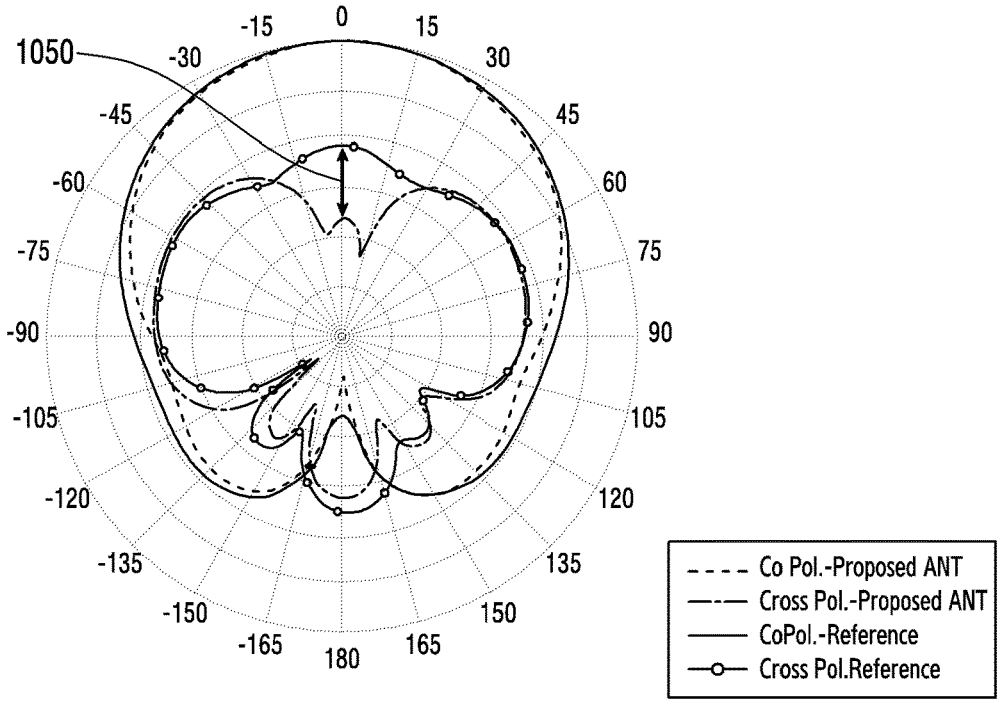

FIG. 10 is a diagram illustrating another example of improvement of a CPR performance of an antenna module including a bending structure of a radiating patch according to various embodiments of the disclosure.

Referring to FIG. 10, the antenna module 1000 may include an antenna PCB 1010, a first antenna port 1011, a second antenna port 1012, a coupling patch 1020, a radiating patch 1030, and a feeding line (or feeding lines) (not illustrated) connected to the antenna ports. The description of the components of the antenna module of FIG. 10 at least partially corresponds to the components of the antenna module of FIG. 3A, and thus the same or similar descriptions may not be repeated here. The radiating patch 1030 may have four cutting portions (or may be referred to as cutting regions) and four bending structures in one metal board. The four cutting portions may include a first cutting portion 1031, a second cutting portion 1032, a third cutting portion 1033, and a fourth cutting portion 1034. The first cutting portion 1031 may correspond to the first bending structure. The second cutting portion 1032 may correspond to the second bending structure. The third cutting portion 1033 may correspond to the third bending structure. The fourth cutting portion 1034 may correspond to the fourth bending structure. The first bending structure, the second bending structure, the third bending structure, and the fourth bending structure may perform the functions of metallic columns that connect the coupling patch 1020 and the radiating patch 1030. Referring to the electric field pattern 1040, it may be identified that symmetry is satisfied unlike the electric field pattern 640 of FIG. 6.

It is identified through the radiation pattern 1050 that the difference 1061 between the co-pol component and the cross-pol component of the signal radiated through the first antenna port is increased by about 15 dB as compared with the case in which there is no bending structure. As compared with the measurement result of FIG. 9, the CPR performance of 3 dB was increased when four bending structures and cutting regions are formed as compared with two bending structures and cutting regions are formed.

Through review of the experimental results of FIGS. 9 and 10, according to various embodiments, the deployment and the shape of the bending structures of the radiating patch 330 may be determined based on the required CPR performance and the number of the bending structures. Because many bending structures require many cutting regions on the radiating patch, the radiation area decreases. Because the reduction of the radiation area causes deterioration of the performance, it is necessary to consider a tradeoff between the communication performance and the CPR performance in design of the deployment and forms of the bending structures of the radiating patch 330.

The items related to the design mentioned in the disclosure may be related as follows.

1. Requirements During Design

1) Radiation requirements: Basic signal gain (target gain)

2) CPR requirements: Ratio of cross polarization components (target item of business provider)

Until the target CPR is achieved, a design is made possible by changing the following change items (e.g., the number of the bending structure, the area of the cutting region, and the like).

3) Support member requirements (weight, size, location, and thickness (=the thickness of the plate of the radiating patch))

According to various embodiments of the disclosure, a configuration of the radiating patch is used as a support member without using any separate support member, and thus production costs and the weight can be reduced.

The size and the thickness of the support member may be determined in consideration of the requirements of the business provider and the size and the location of the communication equipment.

4) Vector sum according to a basic setting (that is, when there is no bending structure) between antenna components As mentioned in FIGS. 7 and 8, when the symmetry of the +45° or −45° of the vector sum is not satisfied, the bending structure and the cutting region may be disposed and formed in consideration of the deviation degree from a symmetry reference. According to an embodiment, the bending structure of the antenna module connected to the radiating patch may be disposed on the radiating patch based on the degree that the vector sum according to the basic setting of the antenna ports deviates from the reference line.

As illustrated in FIGS. 7 and 8, the radiation performance and the CPR performance may be different according to the cutting location, the bending location, and the size of the bent region on the radiating patch. According to an embodiment, the locations of the cutting regions and the bending structures may be determined based on the vector sum according to the basic setting of the dual-polarized antenna. According to an embodiment, the locations of the cutting regions and the bending structures may be determined based on the difference between the vector sum according to the basic setting of the dual-polarized antenna and the direction of the corresponding polarization. Further, according to an embodiment, based on the direction of the vector sum (e.g., whether the direction is inclined vertically or horizontally), the locations of the cutting regions and the bending structures that may cause the vector sum and the polarization direction to coincide with each other on the xy coordinate system of the radiating patch may be identified. Through the input of the corresponding experimental values, a bending structure may be designed at an optimum location (x,y)

As illustrated in FIGS. 9 and 10, performance varies according to whether some bending structures are symmetrical to each other at some locations as well as simply the bending locations, and the number of the bending structures included in the antenna module may be adjusted according the CPR requirements of the business provider. The feature in which the number of the bending structures included in the two antenna modules included in one MMU is different also may be understood as an embodiment of the disclosure.

For a stable support structure, additional bending (that is, secondary bending) may be performed. According to the weight and deployment of the stack structure, it be different whether a stable support structure is necessary. For a more stable structure, the region of the attachment bending surface can be widened during additional bending and the height of the support member can be reduced. For control of a bandwidth, the height of the support member may be controlled and the height of the attachment bending surface also may be controlled to satisfy the same radiation performance.

Because the bending structure of the radiating patch is a metal and the coupling patch is also a metal, attachment of an SMT scheme may be allowed due to contact of metals. Because an additional support member and another material are not necessary, a processor error during a mass-production process and an accumulated error during assembly can be reduced.

In accordance with various example embodiments of the disclosure, an antenna module for dual polarization of a wireless communication system is provided, the antenna module including: an antenna substrate, a first antenna port for a first polarization disposed on the antenna substrate, a second antenna port for a second polarization disposed on the antenna substrate, a coupling patch disposed on the antenna substrate and electrically connected to the first antenna port and the second antenna port, and a radiating patch configured to radiate a signal received from the coupling patch, wherein the antenna module includes a support including at least one region of one surface of the radiating patch bent to connect the radiating patch and the coupling patch.

In some example embodiments, the at least one region may include a first cutting region and a second cutting region, a first metallic object of the radiating patch corresponding to the first cutting region may be bent from the radiating patch and attached to the coupling patch, and a second metallic object of the radiating patch corresponding to the second cutting region may be bent from the radiating patch and attached to the coupling patch.

In some example embodiments, the first metallic object may include a first support portion and a first attachment portion along a cutting line of the first metallic object, the second metallic object may include a second support portion and a second attachment portion along a cutting line of the second metallic object, the first support portion and the second support portion may be disposed to support the radiating patch on the coupling patch, the first attachment portion may be disposed to attach the first metallic object to the coupling patch, and the second attachment portion may be disposed to attach the second metallic object to the coupling patch.

In some example embodiments, a third metallic object of the radiating patch corresponding to the third cutting region may be bent from the radiating patch and attached to the coupling patch, and a fourth metallic object of the radiating patch corresponding to the fourth cutting region may be bent from the radiating patch and attached to the coupling patch.

In some example embodiments, the first antenna port and the second antenna port may be disposed to be line-symmetrical to each other with respect to a reference line, and the first cutting region and the second cutting region may be disposed at locations distinguished with respect to the reference line. As an example, the cutting region and the second cutting region may be substantially line-symmetric to each other.

In some example embodiments, the first cutting region may be disposed such that a ratio of a first component of the first polarization to a second component of the second polarization of a signal is radiated from the first antenna port.

In some example embodiments, the second cutting region may be disposed such that a ratio of a second component of the second polarization to a first component of the first polarization of a signal is radiated from the second antenna port.

In some example embodiments, the first cutting region and the second cutting region may be disposed based on a vector sum of radiation signals of the first port and a vector sum of radiation signals of the second antenna port.

In some example embodiments, at least one metallic object corresponding to the at least one region may be disposed between the radiating patch and the coupling patch, and the antenna module may not include any support other than the at least one metallic object.

In some example embodiments, the radiating patch may include a metallic plate, the coupling patch may include a metallic material, and the bent at least one region of the radiating patch may be attached to the coupling patch through a surface mounting technology (SMT) scheme.

In accordance with various example embodiments of the disclosure, an electronic device for dual polarization of a wireless communication system is provided, the electronic device including at least one processor, at least one transceiver, and a plurality of antenna modules, wherein each of the antenna modules includes an antenna substrate, a first antenna port for a first polarization, a second antenna port for a second polarization, a coupling patch, and a radiating patch, wherein each antenna module includes a support including at least one region of one surface of the radiating patch bent to connect the radiating patch and the coupling patch corresponding to the radiating patch.

In some example embodiments, the at least one region may include a first cutting region and a second cutting region, a first metallic object of the radiating patch corresponding to the first cutting region bent from the radiating patch and attached to the coupling patch, and a second metallic object of the radiating patch corresponding to the second cutting region bent from the radiating patch and attached to the coupling patch.

In some example embodiments, the first metallic object may include a first support portion and a first attachment portion along a cutting line of the first metallic object, the second metallic object may include a second support portion and a second attachment portion along a cutting line of the second metallic object, the first support portion and the second support portion may be disposed to support the radiating patch on the coupling patch, the first attachment portion may be disposed to attach the first metallic object to the coupling patch, and the second attachment portion may be disposed to attach the second metallic object to the coupling patch.

In some example embodiments, the at least one region may include a third cutting region and a fourth cutting region, a third metallic object of the radiating patch corresponding to the third cutting region bent from the radiating patch and attached to the coupling patch, and a fourth metallic object of the radiating patch corresponding to the fourth cutting region bent from the radiating patch and attached to the coupling patch.

In some example embodiments, the first antenna component and the second antenna component disposed in the coupling patch may be disposed to be line-symmetrical to each other with respect to a reference line, and the first cutting region and the second cutting region may be disposed at locations that are distinguished with respect to the reference line. As an example, the cutting region and the second cutting region may be substantially line-symmetric to each other.

In some example embodiments, the first cutting region may be disposed such that a ratio of a first component of the first polarization to a second component of the second polarization of a signal is radiated from the first antenna port has a specific value or more.

In some example embodiments, the second cutting region may be disposed such that a ratio of a second component of the second polarization to a first component of the first polarization of a signal radiated from the second antenna port has a specific value or more.

In some example embodiments, the first cutting region and the second cutting region may be disposed based on a vector sum of radiation signals of the first port and a vector sum of radiation signals of the second antenna port.

In some example embodiments, at least one metallic object corresponding to the at least one region may be disposed between the radiating patch and the coupling patch, and the antenna module may not include any support other than the at least one metallic object.

In some example embodiments, the radiating patch of each of the plurality of antenna modules may include a metallic material, the coupling patch of each of the plurality of antenna modules may include a metallic material, and the radiating patch of each of the plurality of antenna modules may be attached to the corresponding coupling patch through bending of a surface thereof.

In the disclosure, the bending structure formed by cutting and bending a region of the radiating patch included in an existing patch antenna module. A measure of allowing the bending structure to function as a support structure between the coupling patch and the radiating patch and controlling CPR performance in a structure in which the antenna element, the feeding lines, and the coupling patch of the dual-polarized antenna are disposed on the antenna PCB and the radiating patch is disposed on the coupling patch.

By utilizing a portion of the radiating patch as a support structure, a stack structure may be realized without using a separate support member, which may be advantageous in an aspect of costs. In addition, because a portion of the radiation deployment of a metal is also a metallic material, attachment to the coupling patch in the SMT scheme is easily allowed. Because the SMT connects the two structures without producing an additional part for assembly and a separate part is not necessary, manufacturing tolerances can be significantly reduced. In addition, the structure may be further simplified by maintaining the symmetric structure. The simplified structure and the small manufacturing tolerance may be suitable even for demands of equipment including antennas, the number of which has been increased due to introduction of a 5G system.

Because the antenna structure according to various embodiments of the disclosure satisfies the symmetry of the electric field through a simple bending structure, a difference between the pattern of the ports can be minimized and/or reduced and the CPR can be improved. In addition, antenna modules can be mass-produced by realizing a simple process without using an additional structure.

The examples described in this disclosure include non-limiting example implementations of components corresponding to one or more features specified by the appended independent claims and these features (or their corresponding components) either individually or in combination may contribute to ameliorating one or more technical problems deducible by the skilled person from this disclosure.

Furthermore, one or more selected component of any one example described in this disclosure may be combined with one or more selected component of any other one or more example described in this disclosure, or alternatively may be combined with features of an appended independent claim to form a further alternative example.

Further example implementations can be realized comprising one or more components of any herein described implementation taken jointly and severally in any and all permutations. Yet further example implementations may also be realized by combining features of one or more of the appended claims with one or more selected components of any example implementation described herein.

In forming such further example implementations, some components of any example implementation described in this disclosure may be omitted. The one or more components that may be omitted are those components that the skilled person would directly and unambiguously recognize as being not, as such, indispensable for the function of the present technique in the light of a technical problem discernible from this disclosure. The skilled person would recognize that replacement or removal of such an omitted components does not require modification of other components or features of the further alternative example to compensate for the change. Thus further example implementations may be included, according to the present technique, even if the selected combination of features and/or components is not specifically recited in this disclosure.

Two or more physically distinct components in any described example implementation of this disclosure may alternatively be integrated into a single component where possible, provided that the same function is performed by the single component thus formed. Conversely, a single component of any example implementation described in this disclosure may alternatively be implemented as two or more distinct components to achieve the same function, where appropriate.

Methods disclosed in the claims and/or methods according to various embodiments described in the disclosure may be implemented by hardware, software, or a combination of hardware and software.

When the methods are implemented by software, a computer-readable storage medium for storing one or more programs (software modules) may be provided. The one or more programs stored in the computer-readable storage medium may be configured for execution by one or more processors within the electronic device. The at least one program may include instructions that cause the electronic device to perform the methods according to various embodiments of the disclosure.

In the above-described various example embodiments of the disclosure, an element included in the disclosure is expressed in the singular or the plural according to presented detailed embodiments. However, the singular form or plural form is selected appropriately to the presented situation for the convenience of description, and the disclosure is not limited by elements expressed in the singular or the plural. Therefore, either an element expressed in the plural may also include a single element or an element expressed in the singular may also include multiple elements.

While the disclosure has been illustrated and described with reference to various example embodiments thereof, it will be understood that the various example embodiments are intended to be illustrative, not limiting. It will be further understood by one of ordinary skill in the art that various changes in form and detail may be made without departing from the true spirit and full scope of the disclosure, including the appended claims and their equivalents.

What is claimed is:

1. An antenna device for dual polarization of a wireless communication system, the antenna device comprising:

a print circuit board (PCB);

a first feeding line configured to provide a first polarization signal;

a second feeding line configured to provide a second polarization signal;

a patch antenna comprising a radiating region and opening structures, wherein the opening structures include a first opening structure for the first feeding line and a second opening structure for the second feeding line; and wherein objects of the opening structures are disposed to support the radiating region on the PCB, and wherein an interval between the patch antenna and the PCB is smaller than a length of a region of each of the opening structures.

2. The antenna device of claim 1, wherein the opening structures further include a third opening structure and a fourth opening structure.

3. The antenna device of claim 2, wherein the first opening structure and the third opening structure are symmetrical with respect to a center of the patch antenna, and wherein the third opening structure and the fourth opening structure are symmetrical with respect to the center of the patch antenna.

4. The antenna device of claim 1, wherein the radiating region is disposed parallel to the PCB, and wherein support portions of the objects are disposed to be substantially perpendicular to the radiating region.

5. The antenna device of claim 1, wherein the patch antenna corresponds to a metal plate, wherein the metal plate has bent regions corresponding to the objects, and wherein each of the objects are formed by a corresponding bent region of the bent regions of the metal plate.

6. The antenna device of claim 1, wherein each of the objects comprises a first part for supporting the path antenna and a second part for being coupled to the PCB, and wherein each of the objects is disposed to support the radiating region in a bent form from the radiating region.

7. The antenna device of claim 1, wherein the radiating region is configured to radiate a signal via the objects based on the first polarization signal and second polarization signal.

8. The antenna device of claim 1, further comprising:

a coupling patch connected to the first feeding line and the second feeding line on the PCB, and wherein the objects are disposed to connect to the coupling patch and the radiating region.

9. The antenna device of claim 8, wherein the radiating region is configured to radiate a signal via the coupling patch based on the first polarization signal and second polarization signal.

10. The antenna device of claim 1, wherein the first polarization signal is associated with +45° polarization and wherein the second polarization signal is associated with −45° polarization, wherein the opening structures further include, a third opening structure and a fourth opening structure, wherein the first opening structure and the third opening structure are symmetrical with respect to a first reference line, and wherein the third opening structure and the fourth opening structure are symmetrical with respect to a second reference line substantially perpendicular to the first reference line.

11. An electronic device for dual polarization of a wireless communication system, the electronic device comprising:

at least one processor;

at least one transceiver; and a plurality of antenna modules disposed on a printed circuit board (PCB), wherein one antenna module of the plurality of antenna modules comprises:

a first feeding line configured to provide a first polarization signal;

a second feeding line configured to provide a second polarization signal; and a patch antenna comprising a radiating region and opening structures, wherein the opening structures include a first opening structure for the first feeding line and a second opening structure for the second feeding line, wherein objects of the opening structures are disposed to support the radiating region on the PCB, and wherein an interval between the patch antenna and the PCB is smaller than a length of a region of each of the opening structures.

12. The electronic device of claim 11, wherein the opening structures further include a third opening structure and a fourth opening structure.

13. The electronic device of claim 12, wherein the first opening structure and the third opening structure are symmetrical with respect to a center of the patch antenna, and wherein the third opening structure and the fourth opening structure are symmetrical with respect to the center of the patch antenna.

14. The electronic device of claim 11, wherein the radiating region is disposed parallel to the PCB, and wherein support portions of the objects are disposed to be substantially perpendicular to the radiating region.

15. The electronic device of claim 11, wherein the patch antenna corresponds to a metal plate, wherein the metal plate has bent regions corresponding to the objects, and wherein each of the objects is formed by a corresponding bent region of the bent regions of the metal plate.

16. The electronic device of claim 11, wherein each of the objects comprises a first part for supporting the path antenna and a second part for being coupled to the PCB, and wherein each of the objects is disposed to support the radiating region in a bent form from the radiating region.

17. The electronic device of claim 11, wherein the at least one processor is configured to control the radiating region to radiate a signal via the objects based on the first polarization signal and second polarization signal.

18. The electronic device of claim 11, wherein the one antenna module of the plurality of antenna modules further comprises:

a coupling patch connected to the first feeding line and the second feeding line on the PCB, and wherein the objects corresponding to the cutting regions are disposed to connect to the coupling patch and the radiating region.

19. The electronic device of claim 18, wherein the at least one processor is configured to control the radiating region to radiate a signal via the coupling patch based on the first polarization signal and second polarization signal.

20. An antenna device prepared by a process comprising:

providing a metal plate;

forming a patch antenna comprising a radiating region and opening structures, wherein the opening structures are formed by bending regions of the metal plate; and contacting the bent regions of the opening structures to a print circuit board (PCB) in which a first feeding line for a first polarization and a second feeding line for a second polarization, wherein the opening structures include a first opening structure for the first feeding line and a second opening structure for the second feeding line, and wherein an interval between the patch antenna and the PCB is smaller than a length of a region of each of the opening structures.

* * * * *